US007907162B2

(12) United States Patent
Inoue et al.

(10) Patent No.: US 7,907,162 B2
(45) Date of Patent: Mar. 15, 2011

(54) EXPOSURE HEAD, IMAGE FORMING DEVICE, AND IMAGE FORMING METHOD

(75) Inventors: Nozomu Inoue, Matsumoto (JP); Yujiro Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 53 days.

(21) Appl. No.: 12/272,532

(22) Filed: Nov. 17, 2008

(65) Prior Publication Data

US 2009/0129818 A1 May 21, 2009

(30) Foreign Application Priority Data

Nov. 19, 2007 (JP) ..... 2007-299186
Sep. 22, 2008 (JP) ..... 2008-243004

(51) Int. Cl.
*B41J 2/45* (2006.01)

(52) U.S. Cl. ..... 347/238

(58) Field of Classification Search ..... 347/228, 347/238, 241, 244, 256–258, 230
See application file for complete search history.

(56) References Cited

U.S. PATENT DOCUMENTS 3,682,541 A * 8/1972 Adelman ..... 399/166
4,435,064 A * 3/1984 Tsukada et al. ..... 355/1
5,835,119 A * 11/1998 Samuels ..... 347/238
6,330,017 B1 * 12/2001 Suzuki ..... 347/238
2004/0189786 A1 * 9/2004 Yamakawa ..... 347/224

FOREIGN PATENT DOCUMENTS

JP 2000-158705 6/2000

* cited by examiner

*Primary Examiner* — Hai C Pham
(74) *Attorney, Agent, or Firm* — DLA Piper LLP (US)

(57) ABSTRACT

An exposure head includes a substrate having a plurality of light emitting element rows each having a plurality of light emitting elements arranged in a first direction, the light emitting element rows being arranged in a second direction perpendicular or substantially perpendicular to the first direction, and an imaging optical system adapted to image light beams from the light emitting elements on an exposed surface to form respective light-collected sections, and two of the light emitting elements forming the light-collected sections adjacent to each other in the first direction are respectively disposed in the light emitting element rows different from each other, and one of the light emitting element rows is disposed so as to match or substantially match with the meridian plane of the imaging optical system.

12 Claims, 25 Drawing Sheets

EXPOSURE HEAD, IMAGE FORMING DEVICE, AND IMAGE FORMING METHOD

BACKGROUND

1. Technical Field

The present invention relates to an exposure head adapted to image a light beam emitted from a light emitting element with a lens, an image forming device using the exposure head, and an image forming method.

2. Related Art

As such an exposure head, there is proposed a device using a light emitting element array composed of a plurality of light emitting elements arranged linearly as described in, for example, JP-A-2000-158705 (Document 1). In such a line head, a light beam emitted from each of the light emitting elements provided to the light emitting element array is imaged by a lens as a spot to form a spot latent image on an image plane. Thus, the line head in the Document 1 forms a plurality of spot latent images aligned in a main-scanning direction.

Incidentally, in order for forming a more preferable spot latent image, it is desirable to form the spot latent image with a sufficient amount of light using a larger sized light emitting element. However, in the configuration described above having a plurality of light emitting elements arranged linearly, it is not easy to use larger sized light emitting elements. Because, in the case in which the light emitting elements with a larger size are used, there is possibility of causing interference between the light emitting elements respectively forming spot latent images adjacent to each other in the main-scanning direction. In the case in which the pitches between the light emitting elements are reduced for higher resolution, it becomes even more difficult to increase the sizes of the light emitting elements.

SUMMARY

In view of the problem described above, the present invention has an advantage of providing a technology capable of forming a latent image with a sufficient amount of light even in high-resolution conditions.

An exposure head according to an aspect of the invention includes a substrate having a plurality of light emitting element rows each having a plurality of light emitting elements arranged in a first direction, the light emitting element rows being arranged in a second direction perpendicular or substantially perpendicular to the first direction, and an imaging optical system adapted to image light beams from the light emitting elements on an exposed surface to form respective light-collected sections, and two of the light emitting elements forming the light-collected sections adjacent to each other in the first direction are respectively disposed in the light emitting element rows different from each other, and one of the light emitting element rows is disposed so as to match or substantially match with the meridian plane of the imaging optical system.

Further, an image forming device according to another aspect of the invention includes a latent image carrier, and an exposure head having a substrate having two or more light emitting element rows each having a plurality of light emitting elements arranged in a first direction, the light emitting element rows being arranged in a second direction perpendicular or substantially perpendicular to the first direction, and an imaging optical system adapted to image light beams from the light emitting elements of the light emitting element rows on the latent image carrier to form a latent image formed of respective light-collected sections, and two of the light emitting elements forming the light-collected sections adjacent to each other in the first direction are respectively disposed in the light emitting element rows different from each other, and one of the light emitting element rows is disposed so as to match or substantially match with the meridian plane of the imaging optical system.

Further, an image forming method according to another aspect of the invention includes (a) providing the exposure head according to above aspect of the invention, (b) forming a latent image formed of a plurality of light-collected sections on a latent image carrier in the first direction by lighting the light emitting element row at timing corresponding to movement of the latent image carrier, (c) developing the latent image formed in step (b) to form an image, and (d) transferring the image developed in step (c).

In the above aspects (the exposure head, the image forming device, and the image forming method) of the invention, the two light emitting elements forming the light-collected sections adjacent to each other in the first direction are respectively disposed in the different light emitting element rows. Therefore, the size of the light emitting element can be increased, thus it becomes possible to increase the amount of light in the light-collected sections. Therefore, even in high resolution conditions, it becomes possible to form the light-collected sections with sufficient amount of light, thereby preferably performing the latent image formation.

Incidentally, in the exposure head as described above, the alignment between the light emitting element and the imaging optical system becomes important. Therefore, in the invention, one of the light emitting element rows is disposed so as to match with or substantially match with the meridian plane of the imaging optical system. Therefore, by performing the alignment using the light emitting element row matching with the meridian plane as a reference, the alignment between the light emitting elements and the imaging optical system can be executed with ease and high accuracy. Further, the preferable latent image formation becomes possible using the exposure head in which the alignment is performed with high accuracy.

Further, it is possible that one of the light emitting element rows has the light emitting elements arranged symmetrically with respect to the optical axis of the imaging optical system. In such a configuration, as described later, the alignment between the imaging optical system and the light emitting elements in the first direction can be executed with ease and high accuracy.

Alternatively, one of the light emitting elements can be disposed on the optical axis. In such a configuration, as described later, the alignment between the imaging optical system and the light emitting elements in the first direction can be executed with ease and high accuracy.

Further, the imaging optical system can be of anamorphic. The reason is that such an anamorphic imaging optical system is advantageous to designing the optimum optical system suitable to the arrangement forms of the light emitting elements in the light emitting element groups.

Further, the imaging optical system can be arranged to invert the light beams from the light emitting elements in imaging them on the exposed surface. Further, the imaging optical system can be arranged to reduce the light beams from the light emitting elements in imaging them on the exposed surface.

Further, the number of light emitting element rows can be an odd number. The reason is that, as described later, such configurations make it possible to image the light beams emitted from the light emitting elements with relatively preferable aberration and to perform the preferable latent image formation.

Further, it is also possible to configure to provide the light-shielding member provided with a plurality of light guide holes making the light beams emitted from the light emitting elements forming two or more light emitting element rows towards the imaging optical system. Since such a light-shielding member prevents the stray light from entering the imaging optical system, the preferable latent image formation becomes possible.

Further, this aspect of the invention is preferably applied to the configuration using the organic EL elements as the light emitting elements. This is because, the organic EL elements only emit light with low intensity. Therefore, from the viewpoint of forming the light-collected sections with a sufficient amount of light, it is preferable to apply this aspect of the invention advantageous to increasing the amount of light by increasing the size of the light emitting element to such a configuration. In particular, since the bottom emission organic EL elements emit light with lower intensity, it is preferable to apply the present aspect of the invention to the configurations using the bottom emission organic EL elements as the light emitting elements.

Further, in the image forming device according to another aspect of the invention, it is also possible to configure to include the developing section adapted to develop the latent image, which is formed on the latent image carrier by the exposure head, using a liquid developer. This is because, the development with relatively high resolution can be performed with the liquid developer, and it is suitable for preferable image formation.

Further, the exposure head according to another aspect of the invention includes a substrate having a plurality of light emitting elements divided into groups to form light emitting element groups, and a lens array having a plurality of lenses adapted to image the light beams emitted from the light emitting elements of the light emitting element groups as spots to form spot latent images on an image plane, the imaging optical systems being provided corresponding respectively to the light emitting element groups, an image plane moves in a second direction perpendicular or substantially perpendicular to a first direction, a plurality of spot latent images is formed so as to be aligned in the first direction by the light emitting elements emitting light at the timing corresponding to the movement of the image plane, in the light emitting element group, a plurality of light emitting element rows each having a plurality of light emitting elements aligned in a direction corresponding to the first direction is arranged side by side in a direction corresponding to the second direction, the light emitting element rows are shifted from each other in a direction corresponding to the first direction so that the two light emitting elements forming the spot latent images adjacent to each other in the fist direction belong respectively to the light emitting element rows different from each other, and one of the plurality of the light emitting element rows matches with the meridian plane parallel to the direction corresponding to the first direction and including the optical axis of the lens.

Further, an image forming device according to still another aspect of the invention includes a latent image carrier having a surface moving in a second direction perpendicular or substantially perpendicular to a first direction, an exposure head having a substrate having a plurality of light emitting elements divided into groups to form light emitting element groups, and a lens array having a plurality of lenses adapted to image the light beams emitted from the light emitting elements of the light emitting element groups as spots to form spot latent images on a surface of the latent image carrier, the lenses being provided corresponding respectively to the light emitting element groups, a plurality of spot latent images is formed so as to be aligned in the first direction by the light emitting elements emitting light at the timing corresponding to the movement of a surface of a latent image carrier, in the light emitting element group, a plurality of light emitting element rows each having a plurality of light emitting elements aligned in a direction corresponding to the first direction is arranged side by side in a direction corresponding to the second direction, the light emitting element rows are shifted from each other in a direction corresponding to the first direction so that the two light emitting elements forming the spot latent images adjacent to each other in the fist direction belong respectively to the light emitting element rows different from each other, and one of the plurality of the light emitting element rows matches with the meridian plane parallel to the direction corresponding to the first direction and including the optical axis of the lens.

In this aspect (the exposure head, the image forming device) of the invention configured as described above, the plurality of light emitting elements are disposed by being grouped into a plurality of light emitting element groups. In the light emitting element group, a plurality of light emitting element rows each having a plurality of light emitting elements aligned in a direction corresponding to the first direction is arranged side by side in a direction corresponding to the second direction. Moreover, in each of the light emitting element groups, the light emitting element rows are shifted from each other in a direction corresponding to the first direction so that the two light emitting elements forming the spot latent images adjacent to each other in the first direction belong respectively to the light emitting element rows different from each other. In other words, in this aspect of the invention, the two light emitting elements forming the spot latent images adjacent to each other in the first direction are shifted from each other in a direction corresponding to the second direction. Therefore, since the light emitting element can be formed in the relatively large space, the size of the light emitting element can be increased. Therefore, it becomes possible to form the spot latent image with a sufficient amount of light even in high-resolution conditions, thus preferable spot latent image formation becomes possible.

Incidentally, in the configuration of grouping the plurality of light emitting elements into a plurality of light emitting element groups and providing the lens for each light emitting element group as in the aspect of the invention described above, the alignment (hereinafter abbreviated as "alignment" according to needs) between the light emitting element groups and the optical axes of the corresponding lenses becomes important. In particular, in the above aspect of the invention, each of the light emitting element emits light at the timing corresponding to the movement of the image plane in the second direction, thereby forming the plurality of spot latent images aligned in the first direction. Therefore, from a viewpoint of forming these spot latent images at appropriate positions on the image plane, it is more severely required in the direction corresponding to the second direction that the alignment is performed with high accuracy. To cope with this requirement, in this aspect of the invention, one of the plurality of the light emitting element rows matches with the meridian plane parallel to the direction corresponding to the first direction and including the optical axis of the lens. Therefore, it becomes possible to execute the alignment in the direction corresponding to the second direction with ease and high accuracy by performing the alignment using the light emitting row matching with the meridian plane as a reference.

Further, the preferable spot latent image formation becomes possible using the exposure head in which the alignment is performed with high accuracy.

Further, in the light emitting element row matching with the meridian plane, it is possible to dispose the light emitting elements symmetrically around the optical axis. In the configuration of thus providing the light emitting elements, alignment in the direction corresponding to the first direction can also be executed with ease and high accuracy.

Further, in the light emitting element row matching with the meridian plane, it is possible to dispose one of the light emitting elements on the optical axis. The reason is that it becomes possible to execute the alignment in the direction corresponding to the first direction more easily and more accurately.

Further, it is possible that in the light emitting element group, an odd number of light emitting element rows are arranged in the direction corresponding to the second direction, and in the direction corresponding to the second direction, the light emitting element rows are arranged in both sides of the light emitting element row matching with the meridian plane disposed at the center thereof. The reason is that by thus configuring, it is possible to image the light beams emitted from the light emitting elements with relatively preferable aberrations, and to perform preferable spot latent image formation.

Further, the lenses can be anamorphic lenses. The reason is that such an anamorphic lens makes it possible to design the optimum optical system suitable to the arrangement forms of the light emitting elements in the light emitting element groups.

Further, in the image forming device applying this aspect of the invention capable of preferably forming the spot latent images as described above, the spot latent images can be developed using the liquid developer. In other words, by using the liquid developer, development of the latent images can be performed with high resolution. Therefore, it is preferable to perform the development of the spot latent images preferably formed by the aspects of the invention using the liquid developers.

BRIEF DESCRIPTION OF THE DRAWINGS

The invention will now be described with reference to the accompanying drawings, wherein like numbers reference like elements.

DESCRIPTION OF EXEMPLARY EMBODIMENTS

A. Explanations of Terms

Before explaining embodiments of the invention, the terms used in the present specification will be explained.

Figure 1:
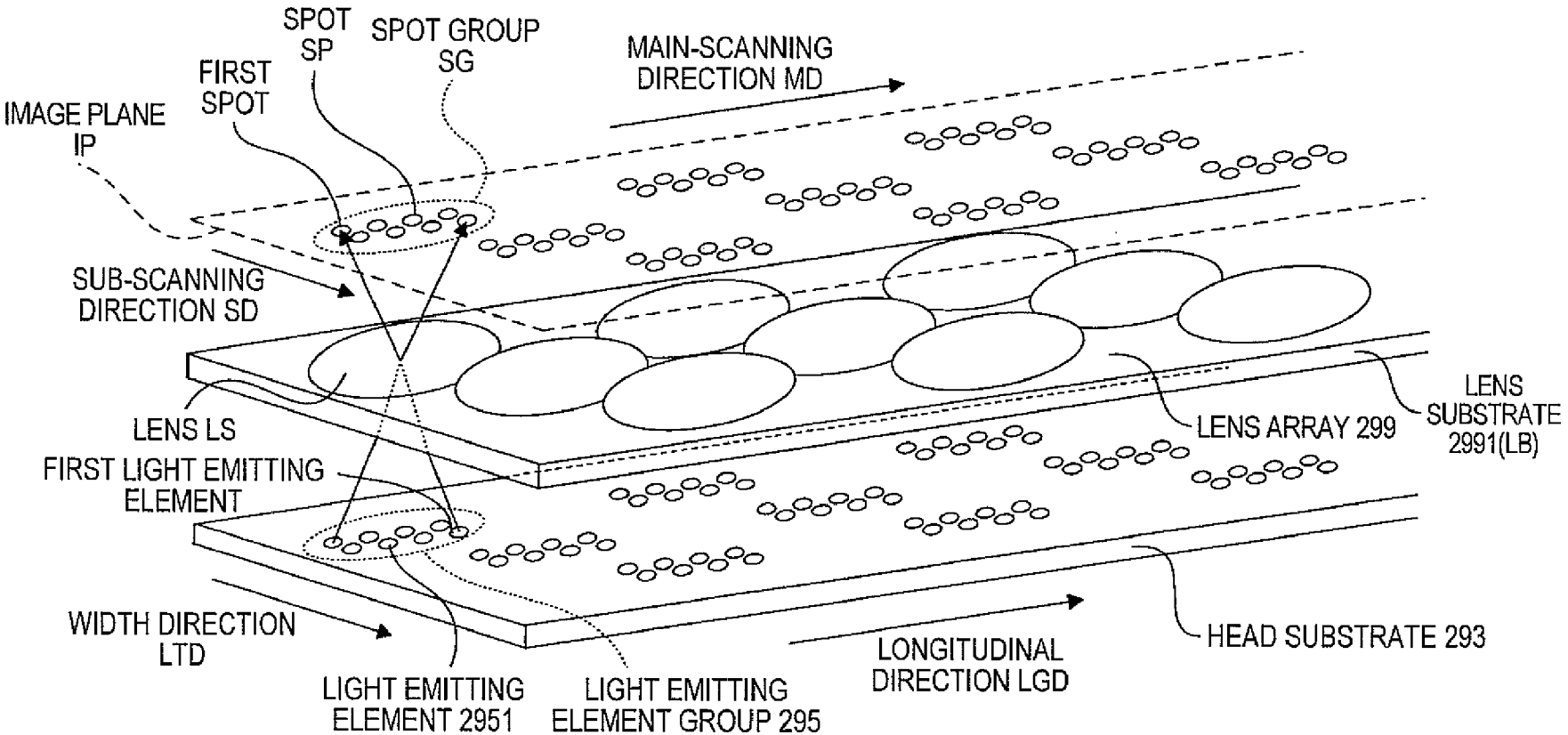
FIG. 1 is a diagram for explaining terms used in the present specification.
Figure 2:
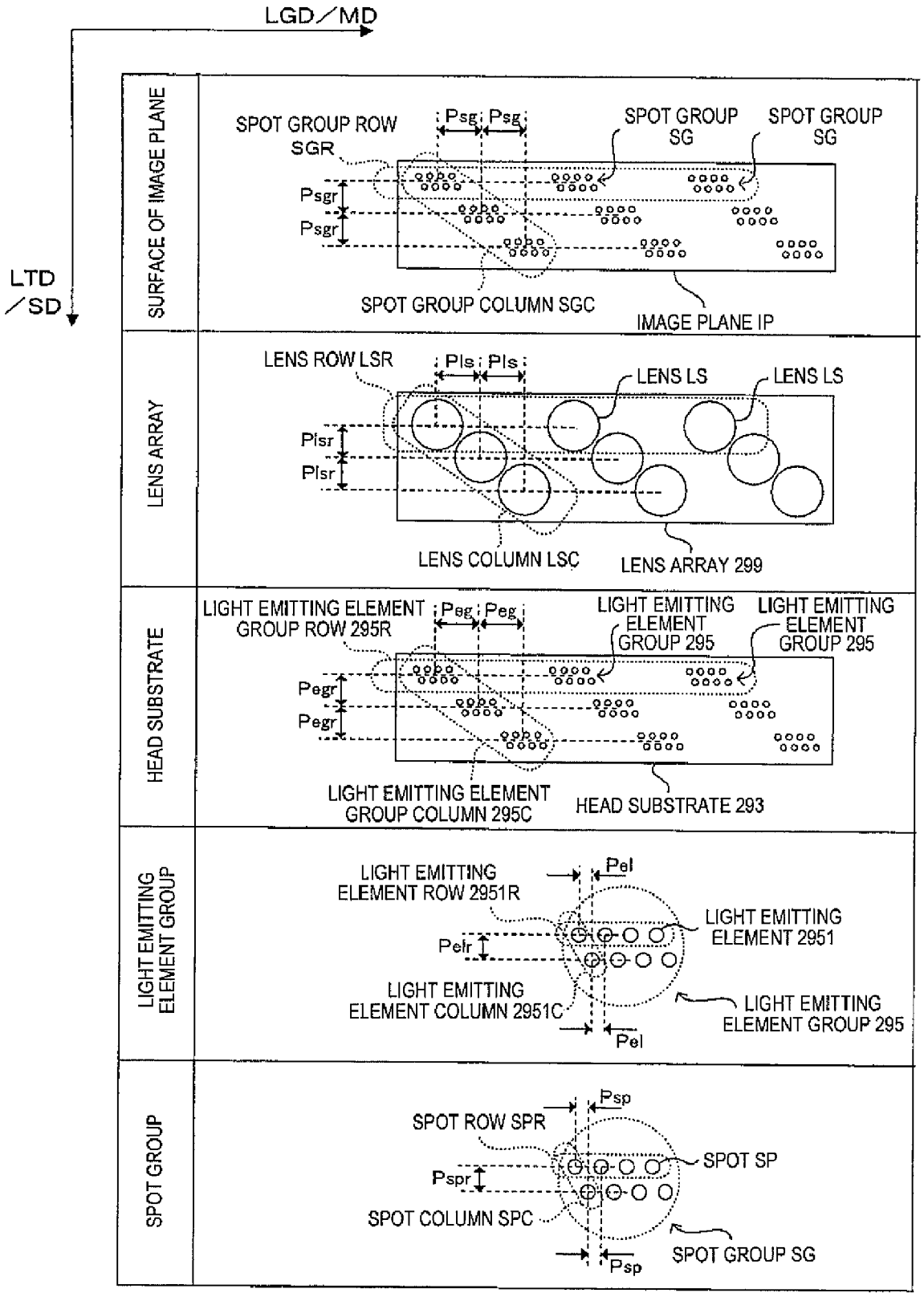
FIG. 2 is a diagram for explaining terms used in the present specification.

FIGS. 1 and 2 are diagrams for explaining the terms used in the present specification. The terms used in the present specification will hereinafter be organized with reference to these drawings. In the present specification, a conveying direction on a surface (image plane IP) of a photoconductor drum 21 is defined as a sub-scanning direction SD, and a direction perpendicular to or substantially perpendicular to the sub-scanning direction SD is defined as a main-scanning direction MD. Further, a line head 29 is disposed facing to the surface (the image plane IP) of the photoconductor drum 21 so that a longitudinal direction LGD thereof corresponds to the main-scanning direction MD, and a width direction LTD corresponds to the sub-scanning direction SD.

An aggregate of a plurality (eight in FIGS. 1 and 2) of light emitting elements 2951, which is disposed on a head substrate 293 in one-to-one correspondence with each of lenses LS included in a lens array 299, is defined as a light emitting element group 295. In other words, the light emitting element group 295 formed of a plurality of light emitting elements 2951 is disposed on the head substrate 293 corresponding to each of the plurality of lenses LS. Further, an aggregate of a plurality of spots SP formed on the image plane IP by imaging the light beams from the light emitting element group 295 on the image plane IP by the lens LS corresponding to the light emitting element group 295 is defined as a spot group SG. In other words, a plurality of spot groups SG can be formed in one-to-one correspondence with a plurality of light emitting groups 295. Further, the spot located uppermost stream in both the main-scanning direction MD and the sub-scanning direction SD in each of the spot groups SG is specifically defined as the first spot. Further, the light emitting element 2951 corresponding to the first spot is specifically defined as the first light emitting element.

Further, spot group row SGR and spot group column SGC are defined as shown in the "SURFACE OF IMAGE PLANE" column in FIG. 2. In other words, a plurality of spot groups SG arranged in the main-scanning direction MD is defined as a spot group row SGR. Further, a plurality of spot group rows SGR is arranged side by side in the sub-scanning direction SD at a predetermined spot group row pitch Psgr. Further, a plurality (three in the drawing) of spot groups SG arranged consecutively at a pitch having a component of the sub-scanning direction SD equal to the spot group row pitch Psgr and a component of the main-scanning direction MD equal to a spot group pitch Psg is defined as a spot group column SGC. It should be noted that the spot group row pitch Psgr is a distance in the sub-scanning direction SD between the geometric centroids of the respective two spot group rows GSR adjacent to each other in the sub-scanning direction SD. Further, the spot group pitch Psg is a distance in the main-scanning direction MD between the geometric centroids of the respective two spot groups SG adjacent to each other in the main-scanning direction MD.

Lens row LSR and lens column LSC are defined as shown in the "LENS ARRAY" column in the drawing. Specifically, a plurality of lenses LS arranged in the longitudinal direction LGD is defined as the lens row LSR. Further, a plurality of lens rows LSR is arranged side by side in the width direction LTD at a predetermined lens row pitch Plsr. Further, a plurality (three in the drawing) of lenses LS arranged consecutively at a pitch having a component of the width direction LTD equal to the lens row pitch Plsr and a component of the longitudinal direction LGD equal to a lens pitch Pls is defined as a lens column LSC. It should be noted that the lens row pitch Plsr is a distance in the width direction LTD between the geometric centroids of the respective two lens rows LSR adjacent to each other in the width direction LTD. Further, the lens pitch Pls is a distance in the longitudinal direction LGD between the geometric centroids of the respective two lens LS adjacent to each other in the longitudinal direction LGD.

Light emitting element group row 295R and light emitting element group column 295C are defined as shown in the "HEAD SUBSTRATE" column in the drawing. Specifically, a plurality of light emitting element groups 295 arranged in the longitudinal direction LGD is defined as the light emitting element group row 295R. Further, a plurality of light emitting group rows 295R is arranged side by side in the width direction LTD at a predetermined light emitting element group row pitch Pegr. Further, a plurality (three in the drawing) of light emitting element groups arranged consecutively at a pitch having a component of the width direction LTD equal to the light emitting element group row pitch Pegr and a component of the longitudinal direction LGD equal to a light emitting element group pitch Peg is defined as a light emitting element group column 295C. It should be noted that the light emitting element group row pitch Pegr is a distance in the width direction LTD between the geometric centroids of the respective two light emitting element group rows 295R adjacent to each other in the width direction LTD. Further, the light emitting element group pitch Peg is a distance in the longitudinal direction LGD between the geometric centroids of the respective two light emitting element groups 295 adjacent to each other in the longitudinal direction LGD.

Light emitting element row 2951R and light emitting element column 2951C are defined as shown in the "LIGHT EMITTING ELEMENT GROUP" column in the drawing. Specifically, in each of the light emitting element groups 295, a plurality of light emitting elements 2951 arranged in the longitudinal direction LGD is defined as the light emitting element row 2951R. Further, a plurality of light emitting element rows 2951R is arranged side by side in the width direction LTD at a predetermined light emitting element row pitch Pelr. Further, a plurality (two in the drawing) of light emitting elements 2951 arranged consecutively at a pitch having a component of the width direction LTD equal to the light emitting element row pitch Pelr and a component of the longitudinal direction LGD equal to a light emitting element pitch Pel is defined as a light emitting element column 2951C. It should be noted that the light emitting element row pitch Pelr is a distance in the width direction LTD between the geometric centroids of the respective two light emitting element rows 2951R adjacent to each other in the width direction LTD. Further, the light emitting element pitch Pel is a distance in the longitudinal direction LGD between the geometric centroids of the respective two light emitting elements 2951 adjacent to each other in the longitudinal direction LGD.

Spot row SPR and spot column SPC are defined as shown in the "SPOT GROUP" column in the drawing. Specifically, in each of the spot groups SG, a plurality of spots SP arranged in the longitudinal direction LGD is defined as the spot row SPR. Further, a plurality of spot rows SPR is arranged side by side in the width direction LTD at a predetermined spot row pitch Pspr. Further, a plurality (two in the drawing) of spots arranged consecutively at a pitch having a component of the width direction LTD equal to the spot row pitch Pspr and a component of the longitudinal direction LGD equal to a spot pitch Psp is defined as a spot column SPC. It should be noted that the spot row pitch Pspr is a distance in the sub-scanning direction SD between the geometric centroids of the respective two spot rows SPR adjacent to each other in the sub-scanning direction SD. Further, the spot pitch Psp is a distance in the main-scanning direction MD between the geometric centroids of the respective two spots SP adjacent to each other in the longitudinal direction LGD.

B. First Embodiment

Figure 3:
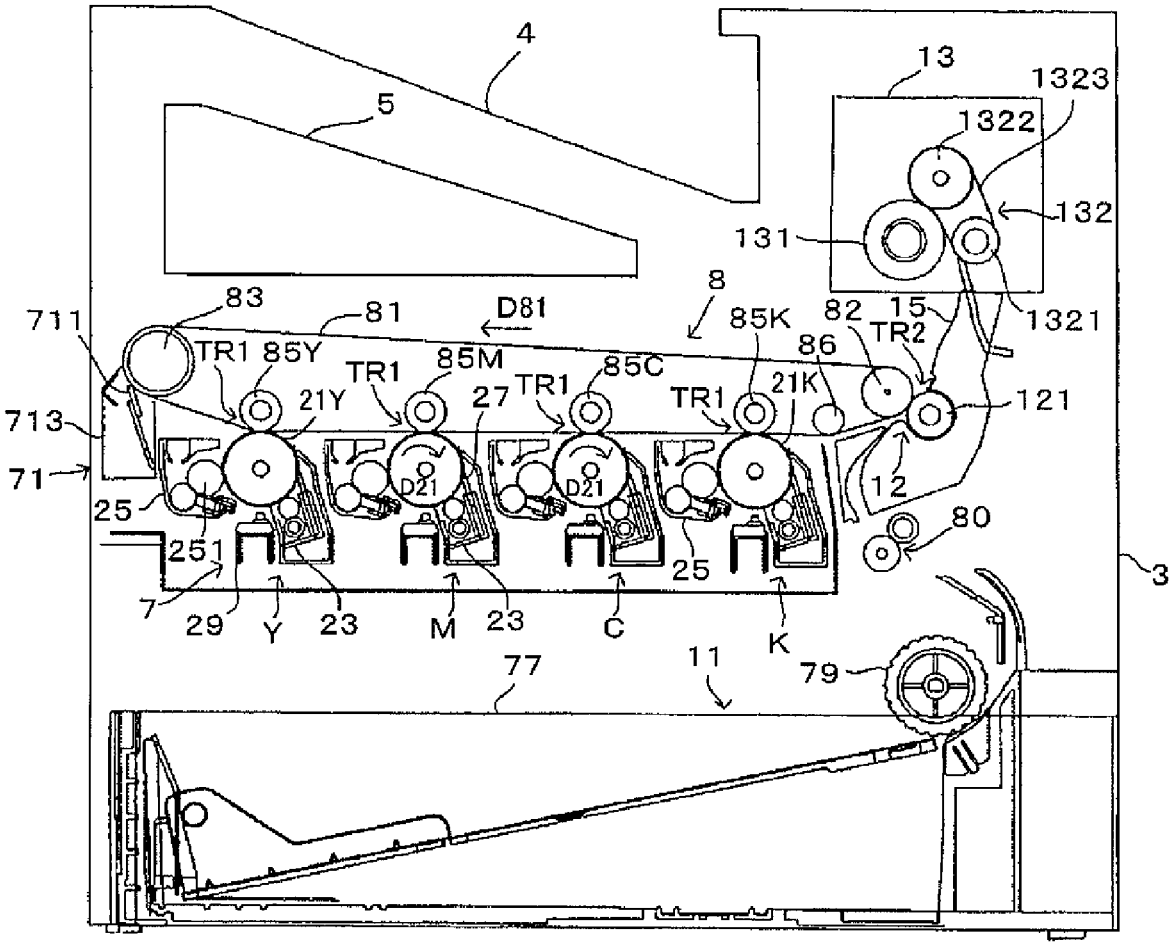
FIG. 3 is a diagram showing an example of an image forming device according to an embodiment of the invention.
Figure 4:
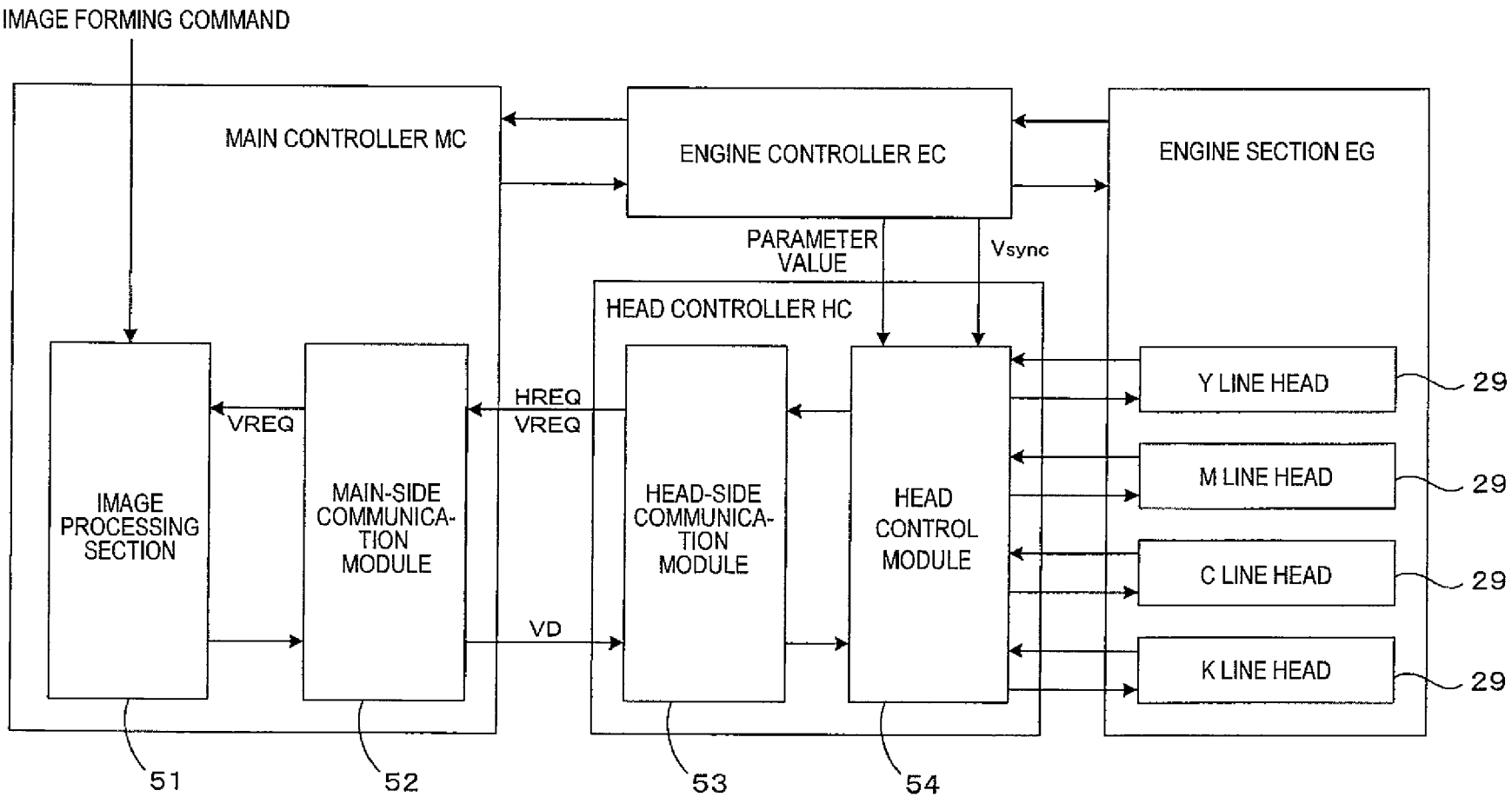
FIG. 4 is a diagram showing an electrical configuration of the image forming device shown in FIG. 3.

FIG. 3 is a diagram showing an example of an image forming device according to an embodiment of the invention. Further, FIG. 4 is a diagram showing an electrical configuration of the image forming device shown in FIG. 3. The device is an image forming device capable of selectively performing a color mode in which a color image is formed by overlapping four colors of toners of black (K), cyan (C), magenta (M), and yellow (Y), and a monochrome mode in which a monochrome image is formed using only the black (K) toner. It should be noted that FIG. 3 is a drawing corresponding to a state when performing the color mode. In the present image forming device, when an image formation command is provided to a main controller MC having a CPU, a memory, and so on from an external device such as a host computer, the main controller MC provides an engine controller EC with a control signal and so on, and a head controller HC with the video data VD corresponding to the image formation command. Further, the head controller HC controls line heads 29 in charge of respective colors based on the video data VD from the main controller MC and a vertical sync signal Vsync and parameter values from the engine controller EC. Thus, an engine section EG performs a prescribed image forming operation, thereby forming an image corresponding to the image formation command on a sheet such as copy paper, transfer paper, a form, or an OHP transparent sheet.

Inside a main housing 3 provided to the image forming device, there is disposed an electric component box 5 housing a power supply circuit board, the main controller MC, the engine controller EC, and the head controller HC. Further, an image forming unit 7, a transfer belt unit 8, and a paper feed unit 11 are also disposed inside the main housing 3. Further, inside the main housing 3 and on the right side thereof in FIG. 3, there are disposed a secondary transfer unit 12, a fixing unit 13, and a sheet guide member 15. It should be noted that the paper feed unit 11 is configured so as to be detachably mounted to a main body 1 of the device. Further, it is arranged that the paper feed unit 11 and the transfer belt unit 8 can separately be detached from the main body to be repaired or replaced.

The image forming unit 7 is provided with four image forming stations Y (for yellow), M (for magenta), C (for cyan), and K (for black) for forming images with respective colors different from each other Further, each of the image forming stations Y, M, C, and K is provided with a cylindrical photoconductor drum 21 having a surface with a predetermined length in the main-scanning direction MD. Further, each of the image forming stations Y, M, C, and K forms a toner image of the corresponding color on the surface of the photoconductor drum 21. The photoconductor drum is disposed so as to have the axial direction thereof substantially parallel to the main-scanning direction MD. Further, each of the photoconductor drums 21 is connected to a dedicated drive motor, and is driven to rotate at a predetermined speed in a direction of the arrow D21 in the drawing. Thus, the surface of the photoconductor drum 21 is moved in the sub-scanning direction SD perpendicular to or substantially perpendicular to the main-scanning direction MD. Further, around the photoconductor drum 21, there are disposed along the rotational direction, a charging section 23, the line head 29, a developing section 25, and a photoconductor cleaner 27. Further, a charging operation, a latent image forming operation, and a toner developing operation are executed by these functional sections. Therefore, when executing the color mode, the toner images respectively formed by all of the image forming stations Y, M, C, and K are overlapped on a transfer belt 81 provided to a transfer belt unit 8 to form a color image, and when executing the monochrome mode, a monochrome image is formed using only the toner image formed by the image forming station K. It should be noted that in FIG. 3, since the image forming stations in the image forming unit 7 have the same configurations as each other, the reference numerals are only provided to some of the image forming stations, and are omitted in the rest of the image forming stations only for the sake of convenience of illustration.

The charging section 23 is provided with a charging roller having a surface made of elastic rubber. The charging roller is configured so as to be rotated by the contact with the surface of the photoconductor drum 21 at a charging position, and is rotated in association with the rotational operation of the photoconductor drum 21 in a driven direction with respect to the photoconductor drum 21 at a circumferential speed. Further, the charging roller is connected to a charging bias generating section (not shown), accepts the power supply for the charging bias from the charging bias generating section, and charges the surface of the photoconductor drum 21 at the charging position where the charging section 23 and the photoconductor drum 21 have contact with each other.

The line head 29 is disposed corresponding to the photoconductor drum 21 so that the longitudinal direction thereof corresponds to the main-scanning direction MD and the width direction thereof corresponds to the sub-scanning direction SD, and the longitudinal direction of the line head 29 is arranged to be substantially parallel to the main-scanning direction MD. The line head 29 is provided with a plurality of light emitting elements arranged in the longitudinal direction, and is disposed separately from the photoconductor drum 21. Further, these light emitting elements emit light onto the surface of the photoconductor drum 21 charged by the charging section 23, thereby forming an electrostatic latent image on the surface thereof.

The developing section 25 has a developing roller 251 with a surface holding the toner. Further, the charged toner is moved to the photoconductor drum 21 from the developing roller 251 by a developing bias applied to the developing roller 251 from a developing bias generating section (not shown) electrically connected to the developing roller 251 at the developing position where the developing roller 251 and the photoconductor drum 21 have contact with each other, thereby making the electrostatic latent image formed by the line head 29 visible.

The toner image thus made visible at the developing position is fed in the rotational direction D21 of the photoconductor drum 21, and then primary-transferred to the transfer belt 81 described in detail later at a primary transfer position TR1 where the transfer belt 81 and each of the photoconductor drums 21 have contact with each other.

Further, the photoconductor cleaner 27 is disposed downstream of the primary transfer position TR1 and upstream of the charging section 23 in the rotational direction D21 of the photoconductor drum 21 so as to have contact with the surface of the photoconductor drum 21. The photoconductor cleaner 27 remove the residual toner on the surface of the photoconductor drum 21 after the primary transfer to clean the surface thereof by having contact with the surface of the photoconductor drum 21.

The transfer belt unit 8 is provided with a drive roller 82, a driven roller 83 (hereinafter also referred to as a blade-opposed roller 83) disposed on the left of the drive roller 82 in FIG. 3, and the transfer belt 81 stretched across these rollers and circularly driven in the direction (a feeding direction) of the arrow D81 shown in the drawing. Further, the transfer belt unit 8 is provided with four primary transfer rollers 85Y, 85M, 85C, and 85K disposed inside the transfer belt 81 respectively opposed one-on-one to the photoconductor drums 21 included in the image forming stations Y, M, C, and K when the photoconductor cartridges are mounted. These primary transfer rollers 85 are electrically connected to respective primary transfer bias generating sections (not shown). Further, as described later in detail, when executing the color mode, all of the primary transfer rollers 85Y, 85M, 85C, and 85K are positioned on the side of the image forming stations Y, M, C, and K as shown in FIG. 3 to press the transfer belt 81 against the photoconductor drums 21 included in the respective image forming stations Y, M, C, and K, thereby forming the primary transfer position TR1 between each of the photoconductor drums 21 and the transfer belt 81. Then, by applying the primary transfer bias to the primary transfer rollers 85 from the primary transfer bias generating section with appropriate timing, the toner images formed on the surfaces of the photoconductor drums 21 are transferred to the surface of the transfer belt 81 at the respective primary transfer positions TR1 to form a color image.

On the other hand, when executing the monochrome mode, the primary transfer rollers 85Y, 85M, and 85C for color printing out of the four primary transfer rollers 85 are separated from the image forming stations Y.M.C respectively opposed thereto, while only the primary transfer roller 85K mainly for monochrome printing is pressed against the image forming station K, thus making only the image forming station K mainly for monochrome printing have contact with the transfer belt 81. As a result, the primary transfer position TR1 is formed only between the primary transfer roller K mainly for monochrome printing and the corresponding image forming station K. Then, by applying the primary transfer bias to the primary transfer roller 85K mainly for monochrome printing from the primary transfer bias generating section with appropriate timing, the toner image formed on the surface of the photoconductor drum 21 is transferred to the surface of the transfer belt 81 at the primary transfer position TR1 to form a monochrome image.

Further, the transfer belt unit 8 is provided with a downstream guide roller 86 disposed on the downstream side of the primary transfer roller 85K mainly for monochrome printing and on the upstream side of the drive roller 82. Further, the downstream guide roller 86 is arranged to have contact with the transfer belt 81 on a common internal tangent of the primary transfer roller 85K and the photoconductor drum 21 at the primary transfer position TR1 formed by the primary transfer roller 85K mainly for monochrome printing having contact with the photoconductor drum 21 of the image forming station K.

The drive roller 82 circularly drives the transfer belt 81 in the direction of the arrow D81 shown in the drawing, and at the same time functions as a backup roller of a secondary transfer roller 121. On the peripheral surface of the drive roller 82, there is formed a rubber layer with a thickness of about 3 mm and a volume resistivity of no greater than 1000 kΩ·cm, which, when grounded via a metal shaft, serves as a conducting path for a secondary transfer bias supplied from a secondary transfer bias generating section, not shown, via the secondary transfer roller 121. By thus providing the rubber layer having an abrasion resistance and a shock absorbing property to the drive roller 82, the impact caused by a sheet entering the contact section (a secondary transfer position TR2) between the drive roller 82 and the secondary transfer roller 121 is hardly transmitted to the transfer belt 81, thus the degradation of the image quality can be prevented.

The paper feed unit 11 is provided with a paper feed section including a paper feed cassette 77 capable of holding a stack of sheets and a pickup roller 79 for feeding the sheet one-by-one from the paper feed cassette 77. The sheet fed by the pickup roller 79 from the paper feed section is fed to the secondary transfer position TR2 along the sheet guide member 15 after the feed timing thereof is adjusted by a pair of resist rollers 80.

The secondary transfer roller 121 is provided so as to be able to be selectively contacted with and separated from the transfer belt 81, and is driven to be selectively contacted with and separated from the transfer belt 81 by a secondary transfer roller drive mechanism (not shown). The fixing unit 13 has a rotatable heating roller 131 having a heater such as a halogen heater built-in and a pressing section 132 for biasing the heating roller 131 to be pressed against an object. Then, the sheet with the image, which is secondary-transferred on the surface thereof, is guided by the sheet guide member 15 to a nipping section formed of the heating roller 131 and a pressing belt 1323 of the pressing section 132, and the image is thermally fixed in the nipping section at predetermined temperature. The pressing section 132 is composed of two rollers 1321, 1322 and the pressing belt 1323 stretched across the two rollers. Further, it is arranged that by pressing a tensioned part of the surface of the pressing belt 1323, which is stretched by the two rollers 1321, 1322, against the peripheral surface of the heating roller 131, a large nipping section can be formed between the heating roller 131 and the pressing belt 1323. Further, the sheet on which the fixing process is thus executed is fed to a paper catch tray 4 disposed on an upper surface of the main housing 3.

Further, in the present device, a cleaner section 71 is disposed facing the blade-opposed roller 83. The cleaner section 71 has a cleaner blade 711 and a waste toner box 713. The cleaner blade 711 removes foreign matters such as the toner remaining on the transfer belt 81 after the secondary transfer process or paper dust by pressing a tip section thereof against the blade-opposed roller 83 via the transfer belt 81. Then the foreign matters thus removed are collected into the waste toner box 713. Further, the cleaner blade 711 and the waste toner box 713 are configured integrally with the blade-opposed roller 83. Therefore, as described below, when the blade-opposed roller 83 moves, the cleaner blade 711 and the waste toner box 713 should also move together with the blade-opposed roller 83.

Figure 5:
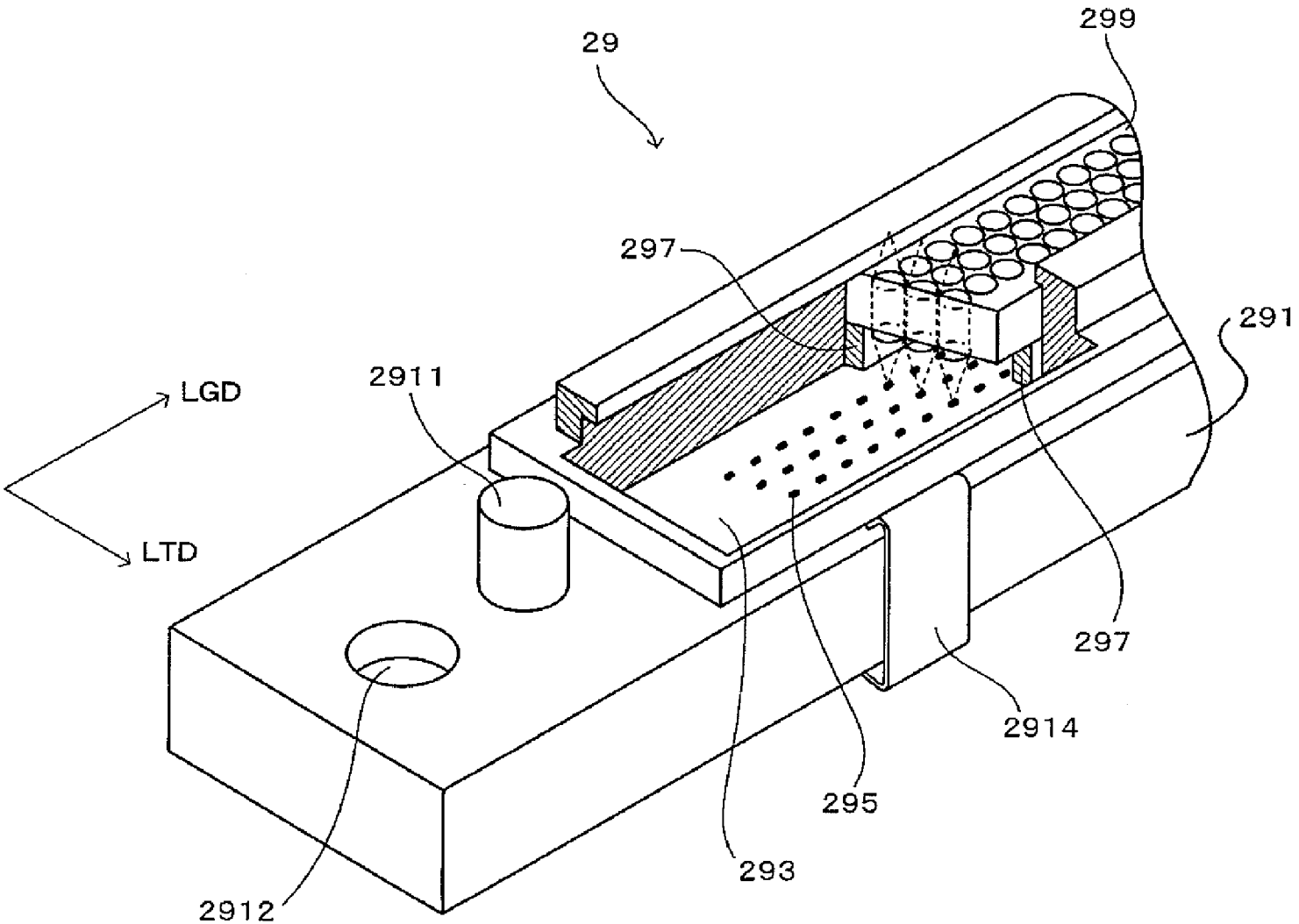
FIG. 5 is a perspective view showing a schematic configuration of an example of a line head according to the embodiment of the invention.
Figure 6:
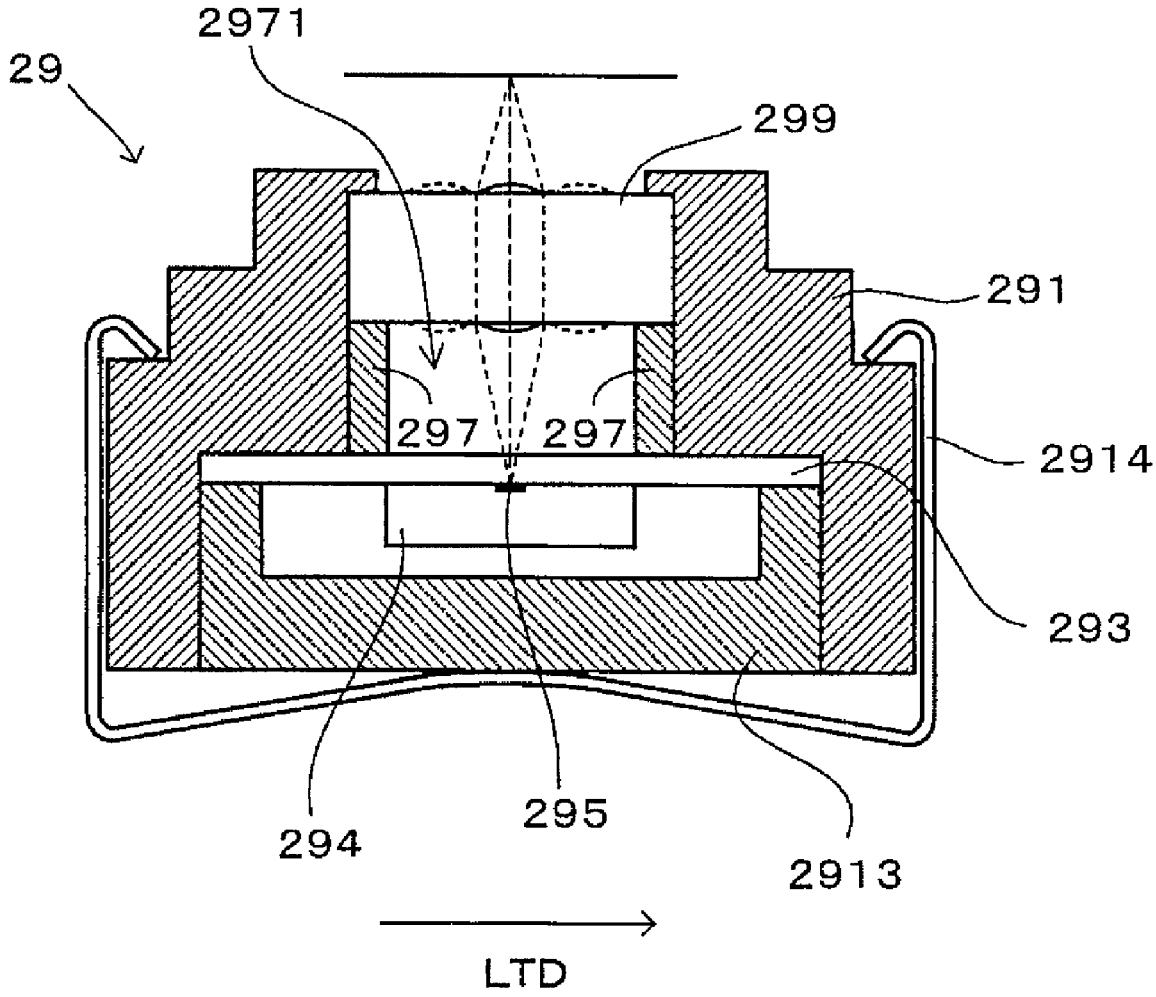
FIG. 6 is a cross-sectional view of a configuration of the line head along the width direction thereof.
Figure 7:
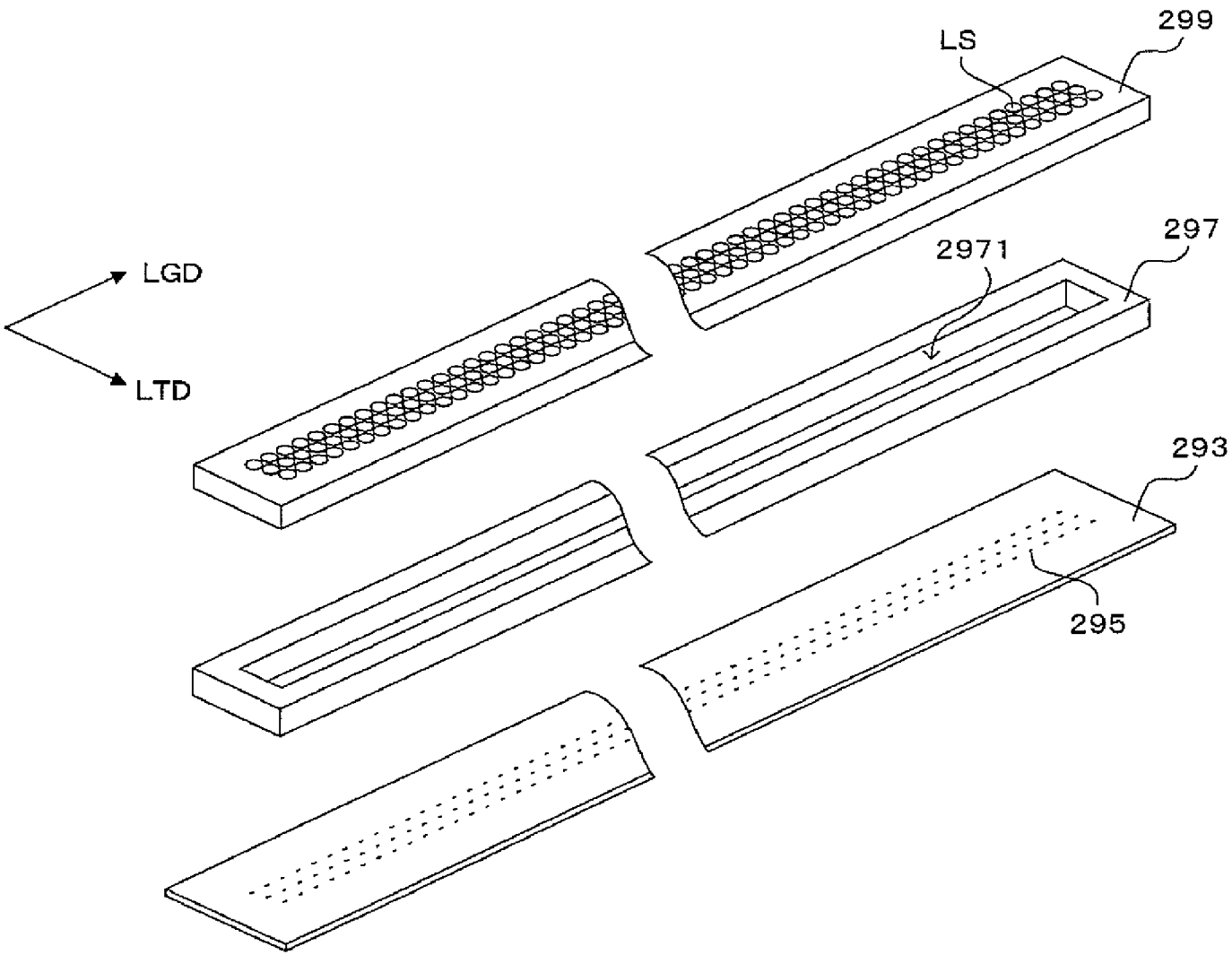
FIG. 7 is an exploded perspective view of the line head.

FIG. 5 is a perspective view showing a schematic configuration of an example of the line head according to the embodiment of the invention. Further, FIG. 6 is a cross-sectional view of a configuration of the line head along the width direction thereof. FIG. 7 is an exploded perspective view of the line head. It should be noted that in FIG. 7, some members such as a case are omitted from the illustrations. The line head 29 is oriented so that the longitudinal direction LGD corresponds to the main-scanning direction MD, and the width direction LTD corresponds to the sub-scanning direction SD. Further, the line head 29 is provided with a case 291, and each end of the case 291 is provided with a positioning pin 2911 and a screw hole 2912. Further, by fitting the positioning pin 2911 into a positioning hole (not shown) provided to a photoconductor cover (not shown) covering the photoconductor drum 21 and positioned with respect to the photoconductor drum 21, the line head 29 is positioned with respect to the photoconductor drum 21. Further, set screws are screwed in and fixed to the screw holes (not shown) of the photoconductor cover via the screw holes 2912, thereby positioning and fixing the line head 29 to the photoconductor drum 21.

The case 291 holds a lens array 299 at a position opposed to the surface of the photoconductor drum 21, and is provided with a spacer 297 and a head substrate 293 disposed inside thereof in this order from the lens array 299. The spacer 297 has a function of regulating the distance between the lens array 299 and the head substrate 293, and has a hollow section 2971 formed inside. Further, the head substrate 293 is a transparent glass substrate, and is provided with a plurality of light emitting element groups 295 disposed on the reverse side (the surface on the opposite side to the lens array 299 out of the two surfaces provided to the head substrate 293). Specifically, the plurality of light emitting element groups 295 is disposed on the reverse side surface of the head substrate 293 two-dimensionally with a predetermined distance in each of the longitudinal direction LGD and the width direction LTD from each other. Here, each of the light emitting element groups 295 is composed of a plurality of light emitting elements arranged as described later. In the line head 29, organic electro-luminescence (EL) elements are used as the light emitting elements. Specifically, the organic EL elements are disposed on the reverse surface of the head substrate 293 as the light emitting elements. Further, the light beam emitted from each of the light emitting elements towards the photoconductor drum 21 proceeds to the lens array 299 passing through the hollow section 2971 of the spacer 297.

As shown in FIG. 6, a retainer 2914 presses a back lid 2913 against the case 291 via the head substrate 293. Specifically, the retainer 2914 has elastic force for pressing the back lid 2913 towards the case 291, and seals the inside of the case 291 light-tightly (in other words, so that light does not leak from the inside of the case 291 and that light does not enter from the outside of the case 291) by pressing the back lid with such elastic force. It should be noted that the retainer 2914 is disposed in each of a plurality of positions in the longitudinal direction LGD. Further, the light emitting element groups 295 are covered by a seal member 294.

Figure 8:
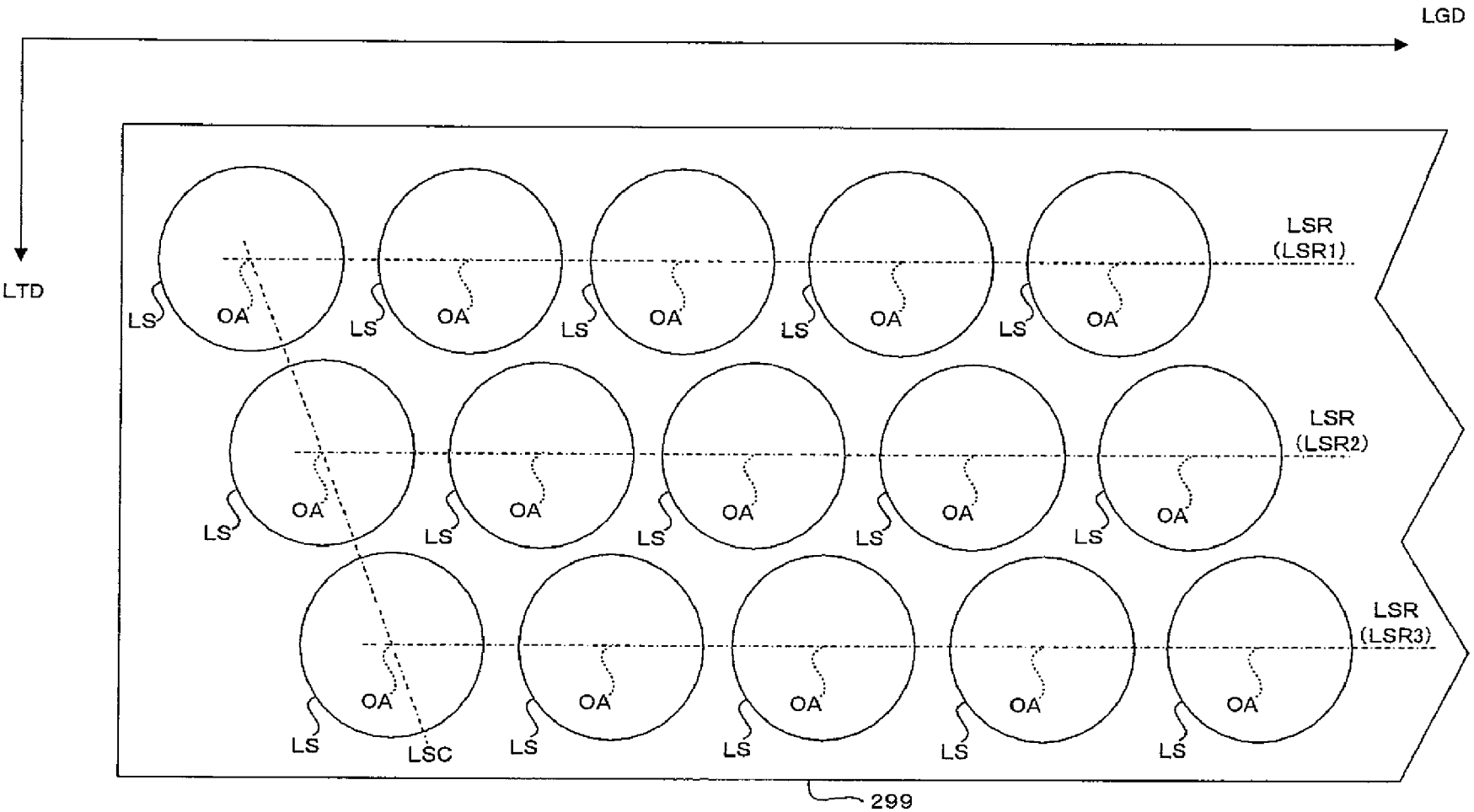
FIG. 8 is a plan view schematically showing a lens array.

FIG. 8 is a plan view schematically showing the lens array, and corresponds to the case of viewing the lens array from the image plane side (the photoconductor drum 21 side). As shown in the drawing, the lens array 299 is provided with a plurality of lenses LS in a manner as described below. In the lens array 299, a plurality of lenses LS is aligned along the longitudinal direction LGD to form the lens row LSR, and the lens row is disposed along each of three rows arranged in the width direction LTD. These three lens rows LSR1 through LSR3 are shifted from each other in the longitudinal direction LGD so that the positions of the respective lenses LS are different from each other in the longitudinal direction LGD.

Figure 9:
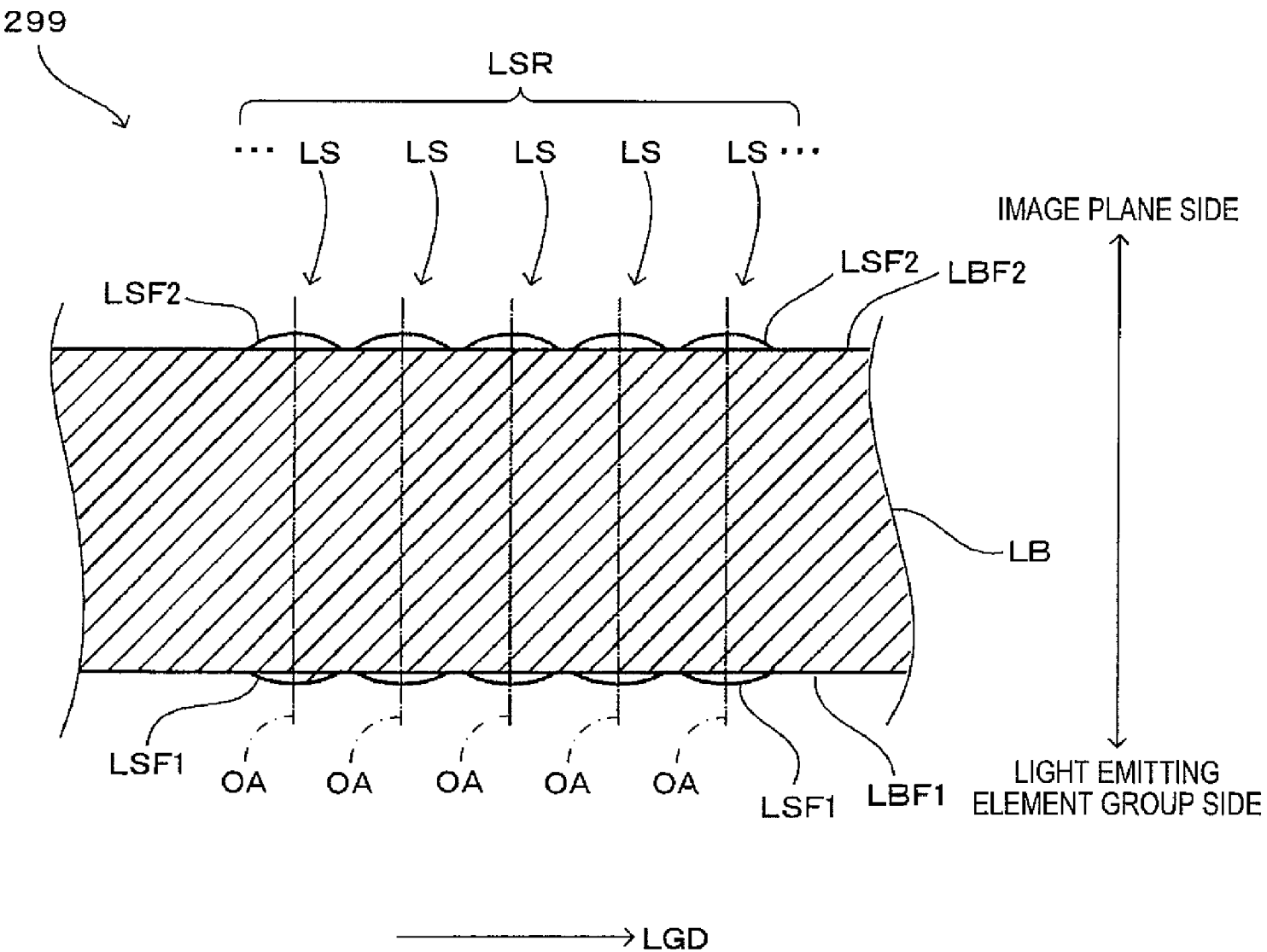
FIG. 9 is a cross-sectional view of the lens array along the longitudinal direction LGD.

FIG. 9 is a cross-sectional view of the lens array along the longitudinal direction LGD. The drawing corresponds to the case of viewing the lens array in the cross-sectional plane including the optical axis OA of each of the lens. In the drawing, the upper side thereof corresponds to the image plane side, and the lower side corresponds to the light emitting element group side. The lens array 299 is provided with one lens substrate LB made of glass, and each of the lenses LS is composed of two lens surfaces LSF1, LSF2 arranged in a direction of the optical axis OA so as to hold the lens substrate LB in between. These lens surfaces LSF1, LSF2 can be formed with, for example, light-curing resin. The lens surface LSF1 of the two lens surfaces is formed on the reverse surface LBF1 of the lens substrate LB, and the lens surface LSF2 is formed on the obverse surface LBF2 of the lens substrate LB. In other words, the lens surface LSF1 is formed on one plane of the lens substrate LB on the light emitting element group side, while the lens surface LSF2 is formed on the other plane thereof.

The lens LS thus configured has an inverting reducing optical characteristic, and the light beams emitted from the light emitting element group 295 are reduced and imaged by the lens LS as an inverted image. Further, as explained later with reference to FIG. 11, the light emitting element group 295 opposed to the lens LS has a flat shape with a larger length in the longitudinal direction LGD than in the width direction LTD. Therefore, in order for imaging the light beams from the light emitting element group 295 with a preferable aberration corresponding to such a shape of the light emitting element group 295, an anamorphic lens having an optical characteristic in the width direction LTD and an optical characteristic in the longitudinal direction LGD different from each other is adopted as the lens LS of the present embodiment.

Figure 10:
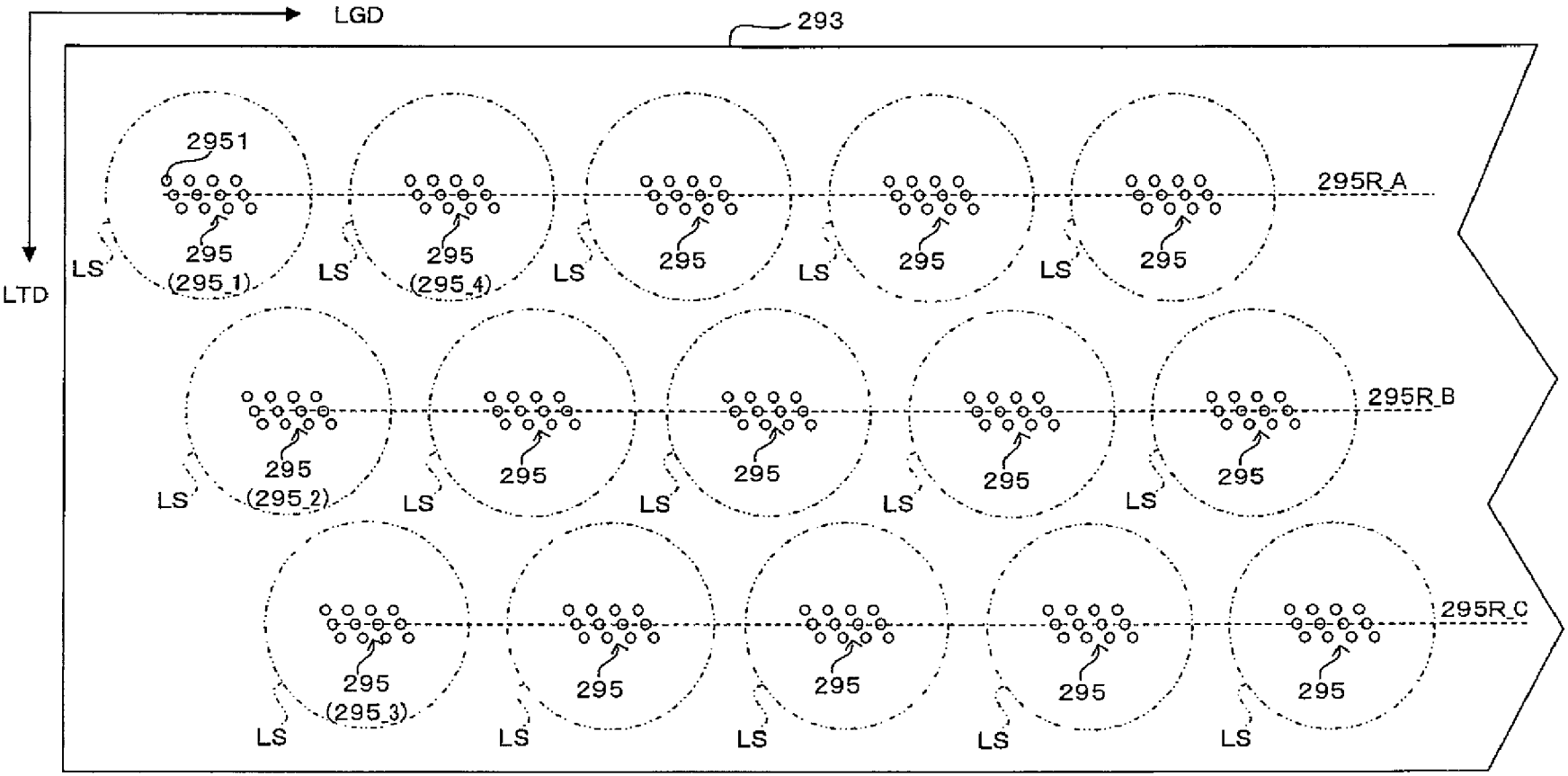
FIG. 10 is a diagram showing a configuration of the reverse side of a head substrate.

FIG. 10 is a diagram showing a configuration of the reverse surface of the head substrate, corresponding to the case in which the reverse surface is viewed from the obverse surface of the head substrate. It should be noted that in FIG. 10, although the lenses LS are illustrated with double-dashed lines, this does not denote that the lenses LS are disposed on the reverse surface of the substrate, but denotes that the light emitting element groups 295 are disposed corresponding one-on-one to the lenses LS. As shown in FIG. 9, a plurality of light emitting element group columns 295C, each having three light emitting element groups 295 (e.g., the light emitting element groups 295_1, 295_2, and 295_3) disposed at positions different from each other in the width direction LTD, are arranged in the longitudinal direction LGD. In other words, the light emitting element group rows 295R having a plurality of light emitting element groups 295 arranged along the longitudinal direction LGD are arranged in the width direction LTD in three rows (295R_A, 295R_B, and 295R_C). In this case, the light emitting element group rows 295R are shifted from each other in the longitudinal direction LGD so that the positions of the light emitting element groups 295 become different from each other in the longitudinal direction LGD.

Figure 11:
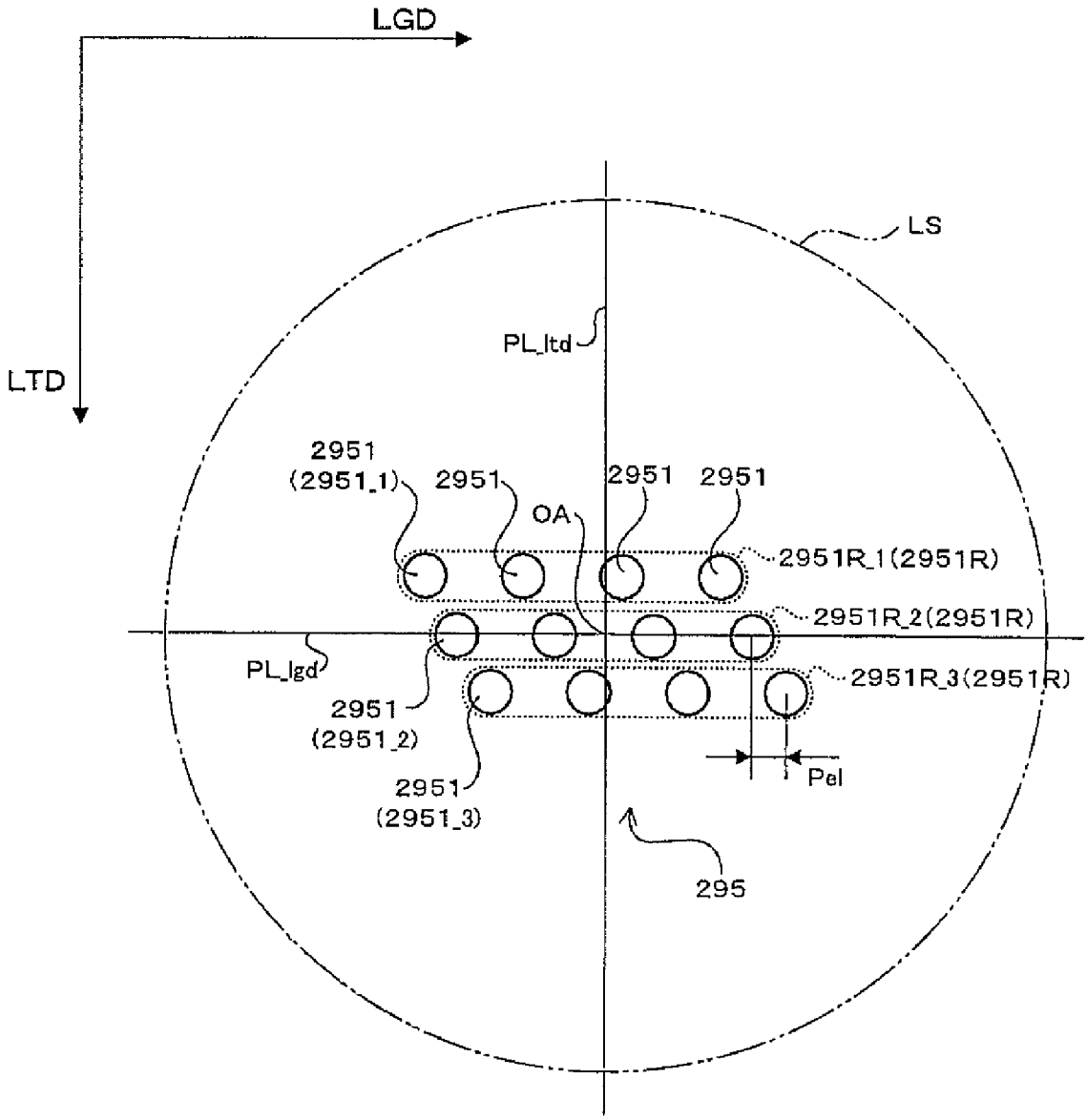
FIG. 11 is a diagram showing a configuration of a light emitting element group in the first embodiment.

FIG. 11 is a diagram showing a configuration of the light emitting element group in the first embodiment. As shown in the drawing, an odd number (three light emitting element rows 2951R_1, 2951R_2, and 2951R_3 in the drawing) of light emitting element rows 2951R, each having four light emitting elements aligned along the longitudinal direction, are arranged in parallel in the width direction LTD. The light emitting element rows 2951R_1, 2951R_2, and 2951R_3 are arranged so as to be shifted the light emitting element pitch Pel from each other in the longitudinal direction LGD, and the light emitting elements 2951 are located at positions different from each other in the longitudinal direction LGD. As a result, the light emitting element group 295 has a flat shape having a larger length in the longitudinal direction LGD than in the width direction LTD. It should be noted that "the light emitting element pitch Pel" corresponds to a pitch between the two light emitting elements 2951, which forms the spot latent images adjacent to each other in the main-scanning direction MD, and "the spot latent image" is a latent image formed on the surface of the photoconductor drum by the light beam from the light emitting element 2951 imaged as a spot. Therefore, as described later, the spot latent images adjacent to each other in the main-scanning direction MD are respectively formed by the light emitting elements 2951 (e.g., the light emitting elements 2951_1, 2951_2 in the drawing) belonging to the different light emitting element rows 2951R from each other.

Further, as shown in the drawing, in the light emitting element group 295, one light emitting element row 2951R_2 of the three light emitting element rows 2951R matches with the meridian plane PL_lgd. In other words, each of the light emitting elements 2951 of the light emitting element row 2951R_2 intersects the meridian plane PL_lgd. Further, in the light emitting element row 2951R_2 matching with the meridian plane PL_lgd, each of the light emitting elements 2951 is disposed symmetrically around the optical axis OA. It should be noted that the meridian plane PL_lgd is a plane parallel to the longitudinal direction LGD and including the optical axis OA of the lens LS. Further, in the drawing, the optical axis OA is represented as an intersection between the plane PL_ltd parallel to the width direction LTD and including the optical axis OA and the meridian plane PL_lgd.

Further, in the light emitting element group 295, the light emitting element row 2951R_2 matching with the meridian plane PL_lgd is centered, and the other light emitting element rows 2951R are disposed on both sides thereof in the width direction LTD. In other words, in the width direction LTD, the same number (one in the first embodiment) of light emitting element rows 2951R are disposed respectively on both sides of the light emitting element row 2951R_2. The reason to arrange the light emitting element rows 2951R as described above is as follows. That is, if the light emitting element rows 2951R are not disposed on both sides centering around the light emitting element row 2951R_2, namely in the case, for example, in which the light emitting element row 2951R_3 is disposed above the light emitting element row 2951R_1 in the drawing, the light emitting element row 2951R_3 is disposed more distantly from the optical axis OA. As a result, there are some cases in which the aberration of the image obtained by imaging the light beams from the light emitting element row 2951R_3 becomes worse. In contrast, in the first embodiment, the light emitting element rows are disposed on both sides centering around the light emitting element row 2951R_2 matching with the meridian plane PL_lgd, and therefore, it becomes possible to dispose each of the light emitting element rows 2951R relatively closer to the optical axis OA. Therefore, it becomes possible to image the light beam emitted from each of the light emitting elements 2951 by the lens LS with a preferable aberration. A latent image forming operation by the line head 29 described above will hereinafter be explained.

Figure 12:
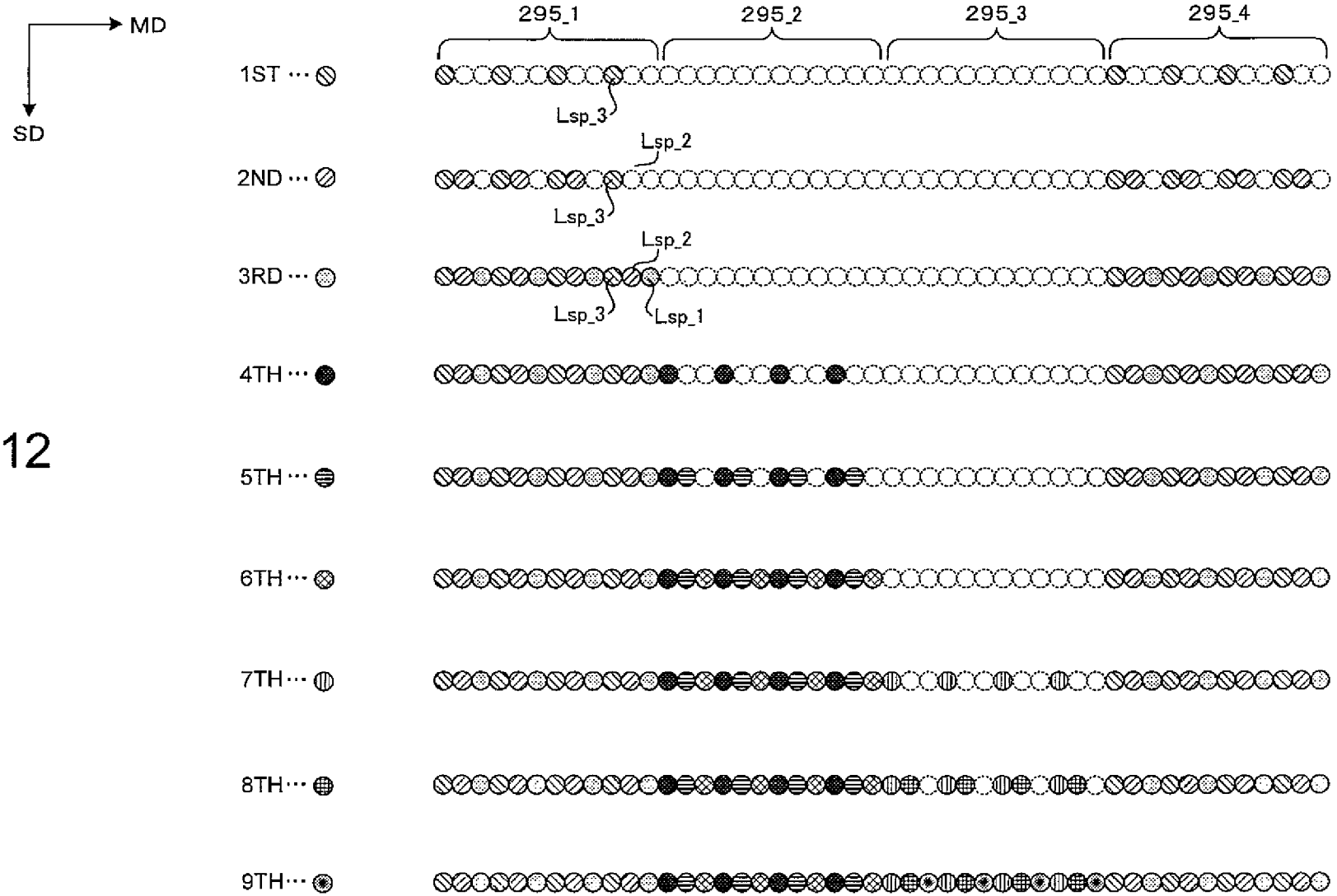
FIG. 12 is a diagram showing a spot latent image forming operation by the line head.

FIG. 12 is a diagram showing a spot latent image forming operation by the line head. Hereinafter, the spot latent image forming operation by the line head according to the first embodiment will be explained with reference to FIGS. 10 through 12. Further, for facilitating understanding of the invention, the case in which a plurality of spot latent images is aligned on a straight line extending in the main scanning direction MD to form a line latent image will be explained here. As a rough outline, in the latent image forming operation, the head control module 54 makes each of the light emitting elements 2951 at predetermined timing while conveying the surface of the photoconductor drum 21 in the sub-scanning direction SD, thereby forming a plurality of spots aligned in the main-scanning direction MD. Hereinafter, the detail of the operation will be explained.

Firstly, when the light emitting element row 2951R_3 of each of the light emitting element groups 295 (e.g., 295_1, and 295_4) belonging to the light emitting element group row 295R_A on the uppermost stream side in the width direction LTD emits light, the spot latent images represented by the hatching pattern shown in the "1ST" row of FIG. 12. It should be noted that the outline circles in FIG. 12 each represent a spot latent image which has not yet been formed, and will be formed later. Further, in the drawing, the reference numerals 295_1, 295_2, 295_3, and 295_4 denote that the spot latent images in the corresponding columns are formed by the light emitting element groups denoted with the respective reference numerals. Further, in FIG. 12, the reference symbols Lsp_1 through Lsp_3 are specifically provided to the spot latent images formed by the light emitting elements 2951_1 through 2951_3, respectively.

The light emitting element row 2951R_2 emits light subsequently to the light emission of the light emitting element row 2951R_3 to form the spot latent images represented by the hatching pattern in the "2ND" row of FIG. 12. Subsequently, the light emitting element row 2951R_1 emits light to form the spot latent images represented by the hatching pattern in the "3RD" row of FIG. 12. Here, the reason to sequentially emit light from the light emitting element row 2951R on the downstream side in the width direction LTD is for coping with the inverting characteristic provided to the lens LS.

Subsequently, the light emitting element groups 295 (e.g., 295_2) belonging to the light emitting group row 295R_B on the downstream side of the light emitting element group row 295R_A in the width direction LTD performs the light emitting operation in the same manner as the light emitting element group row 295R_A to form the spot latent images represented by the hatching patterns shown in the "4TH" through "6TH" rows of FIG. 12. Further, the light emitting element groups 295 (e.g., 295_3) belonging to the light emitting group row 295R_C on the downstream side of the light emitting element group row 295R_B in the width direction LTD performs the light emitting operation in the same manner as the light emitting element group row 295R_A to form the spot latent images represented by the hatching patterns shown in the "7TH" through "9TH" rows of FIG. 12. As described above, by performing the light emitting operations corresponding to the first through ninth times, the plurality of spot latent images are formed in a line in the main-scanning direction MD.

As described above, in the first embodiment, the light emitting element rows 2951R are shifted from each other in the longitudinal direction so that the two light emitting elements 2951 for forming the spot latent images adjacent to each other in the main-scanning direction MD belong to the light emitting element rows 2951R different from each other. In a specific explanation, the two light emitting elements 2951_1, 2951_2 forming the spot latent images Lsp_1, Lsp_2 adjacent to each other in the main-scanning direction MD belong respectively to the light emitting element rows 2951R_1, 2951R_2 different from each other, for example. In other words, in the first embodiment, the two light emitting elements 2951 (e.g., 2951_1, 2951_2) forming the spot latent images adjacent to each other in the main-scanning direction MD are disposed so as to be shifted from each other in the width direction LTD. Therefore, since the light emitting element 2951 can be formed in the relatively large space, the size of the light emitting element 2951 can be increased. Therefore, it becomes possible to form the spot latent image with a sufficient amount of light even in high-resolution conditions, thus preferable spot latent image formation becomes possible.

Further, such a configuration of the light emitting element group 295 allowing the size of the light emitting element 2951 to grow is suitable for the line head 29 having organic EL elements as the light emitting elements 2951. This is because, the organic EL elements only emit light with low intensity. Therefore, from the viewpoint of forming the spots SP with a sufficient amount of light, with respect to such a configuration, it is preferable to apply the configuration described above advantageous to increasing the amount of light of the light emitting element 2951 by increasing the size of the light emitting element 2951. In particular, since the bottom emission organic EL elements emit light with lower intensity, it is preferable to apply the configuration described above to the configurations using the bottom emission organic EL elements as the light emitting elements 2951.

Incidentally, in the configuration of providing the lens LS in correspondence with each of the light emitting element group 295 as in the line head 29 described above, the alignment between the light emitting element groups 295 and the optical axes OA of the respective lenses LS becomes important. In particular, in the embodiment described above, each of the light emitting elements 2951 emits light at the timing corresponding to the movement of the surface of the photoconductor drum 21 in the sub-scanning direction SD, thereby forming the plurality of spot latent images aligned in the main-scanning direction MD. Therefore, from a viewpoint of forming these spot latent images at appropriate positions on the surface of the photoconductor drum 21, it is more severely required in the width direction LTD corresponding to the sub-scanning direction SD that the alignment is performed with high accuracy. In this regard, in the line head 29 described above, the light emitting element row 2951R_2 matches with the meridian plane PL_lgd. Therefore, it becomes possible to execute the alignment in the width direction LTD with ease and high accuracy by performing the alignment using the light emitting element row 2951R_2 as a reference. Further, in the first embodiment, each of the light emitting elements 2951 are disposed symmetrically around the optical axis OA in the light emitting element row 2951R_2, and it is arranged that the alignment thereof in the longitudinal direction LGD can also be performed with ease and high accuracy. Further, by forming the latent images with the line head 29 in which the alignment has thus been performed with high accuracy, the preferable spot latent image formation becomes possible. Therefore, the position adjustment operation for executing the alignment will hereinafter explained.

Figure 13:
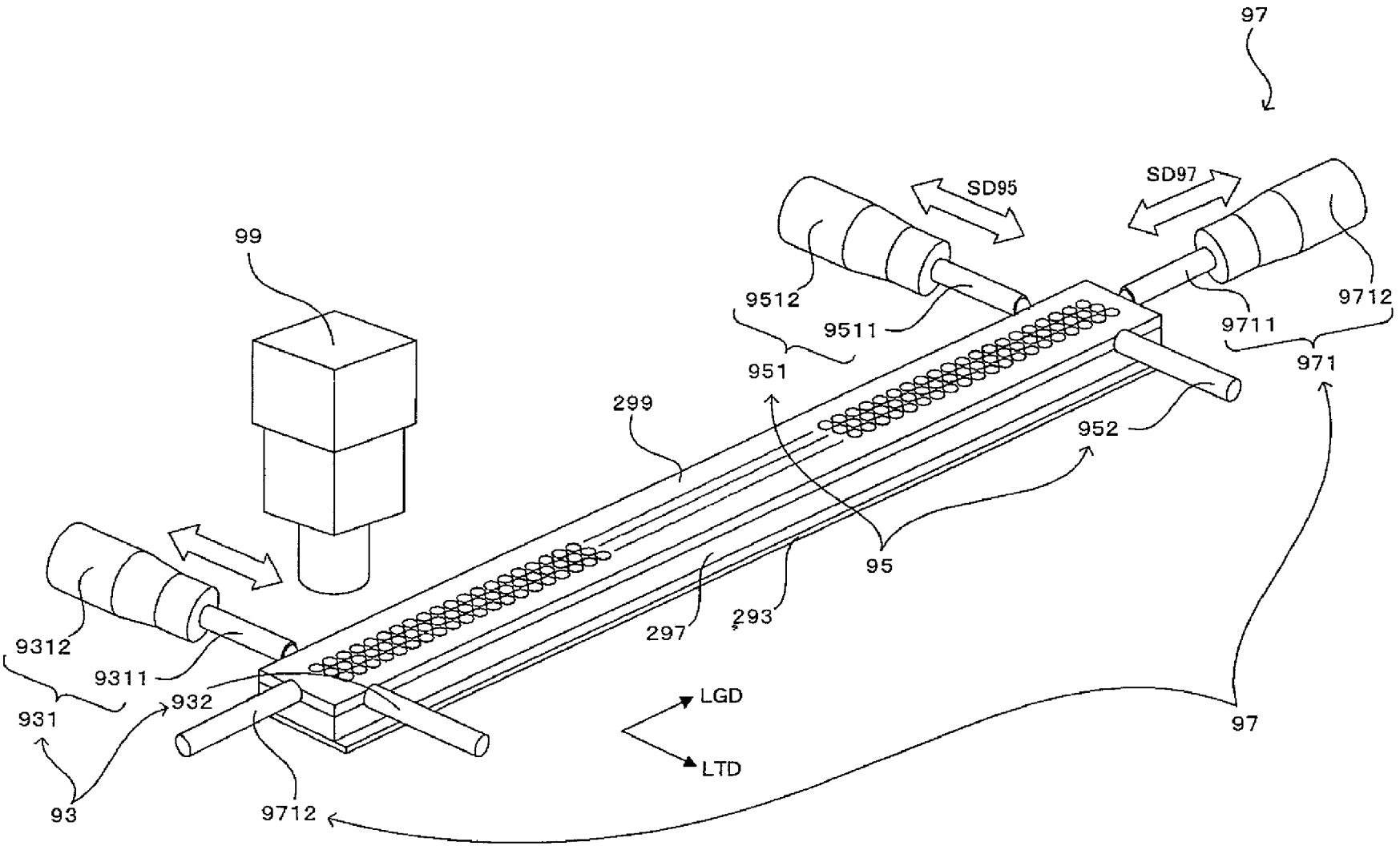
FIG. 13 is a perspective view showing an array moving mechanism and an observation optical system provided to a position adjustment device.
Figure 14:
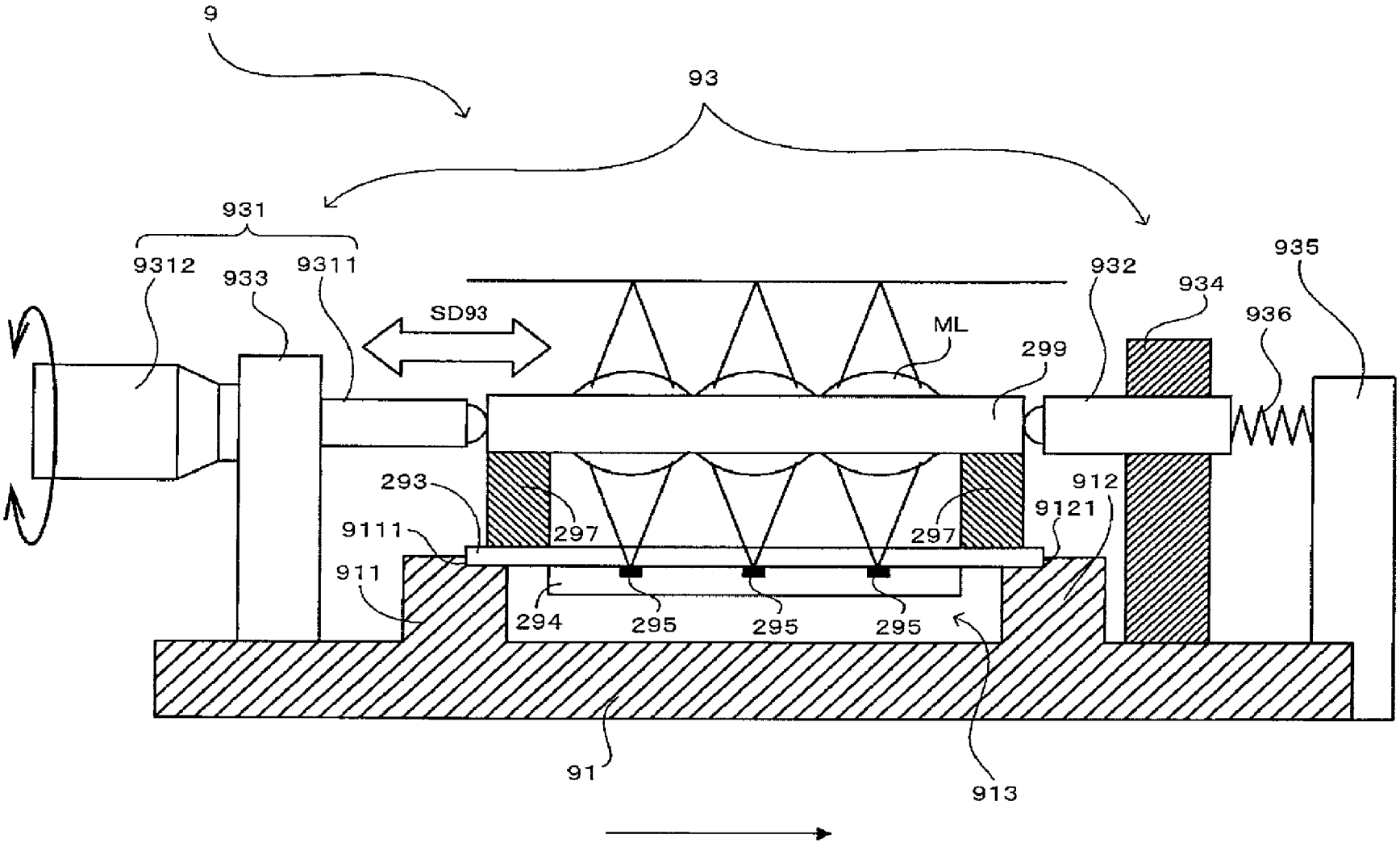
FIG. 14 is a diagram of the position adjustment device viewed along the longitudinal direction.
Figure 15:
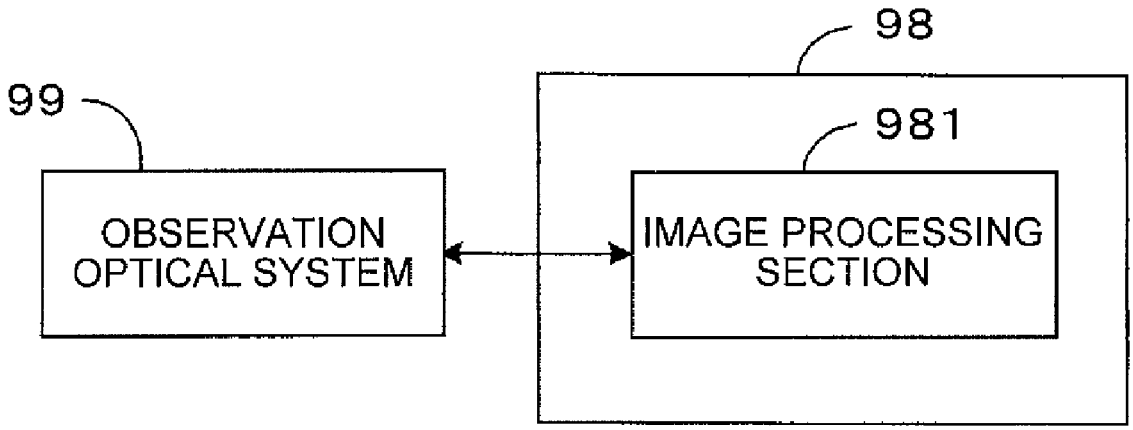
FIG. 15 is a block diagram showing an electrical configuration of the position adjustment device.

FIG. 13 is a perspective view showing an array moving mechanism and an observation optical system provided to the position adjustment device of the line head, FIG. 14 is a diagram of the position adjustment device of the line head viewed along the longitudinal direction thereof, and FIG. 15 is a block diagram showing an electrical configuration of the position adjustment device of the line head. Further, the position adjustment operation can be performed by the position adjustment device 9. The position adjustment device 9 is provided with a position adjustment device controller 98, and the position adjustment device controller 98 is capable of controlling each sections of the position adjustment device 9. Further, the position adjustment device 9 of the line head is provided with a substrate holding section 91 adapted to hold the head substrate 293, three array moving mechanisms 93, 95, 97, and an observation optical system 99.

The substrate holding section 91 is configured to be capable of holding the head substrate 293 provided with the light emitting element groups 295 on the reverse surface thereof. Specifically, the substrate holding section 91 is provided with two mounting stages 911, 912, and a retraction space 913 between the both mounting stages 911, 912. The two mounting stages 911, 912 are provided with L-shaped notch sections 9111, 9121, respectively. Further, these notch sections 9111, 9121 are disposed so as to be opposed to each other. Further, when holding the head substrate 293 by the substrate holding section 91, one end of the head substrate 293 in the width direction LTD thereof is mounted on the notch section 9111, and then the other end of the head substrate 293 in the width direction LTD is mounted on the notch section 9121. The distance between the notch sections 9111, 9121 is set so as to limit the movement of the head substrate 293 in the width direction LTD, and the head substrate 293 mounted on the substrate holding section 91 is limited by the notch sections 9111, 9121 in the movement in the width direction LTD. It should be noted that there is provided a similar mechanism for limiting the movement of the head substrate 293 mounted thereon to the substrate holding section 91 with respect also to the longitudinal direction LGD substantially perpendicular to the width direction LTD. As described above, the substrate holding section 91 holds the head substrate 293 so as to limit the movement of the head substrate 293 in both of the width direction LTD and the longitudinal direction LGD of the head substrate 293 mounted thereon.

Further, in the condition in which the head substrate 293 is mounted on the substrate holding section 91, although the light emitting element groups 295 and the seal member 294 disposed on the reverse surface of the head substrate 293 protrude from the head substrate 293 towards a lower side in the direction of gravitational force, the retraction space 913 is provided to the substrate holding section 91 as described above. By thus providing the retraction space 913, the light emitting element groups 295 and the seal member 294 are prevented from having contact with other members.

The first array moving mechanism 93 is provided with a micrometer head 931 and a biasing rod 932. The micrometer head 931 is supported by a support member 933 fixed to the substrate holding section 91. Further, a moving rod 9311 as a spindle of the micrometer head 931 moves forward and backward in a stroke direction SD93 in accordance with rotational movement of a knob 9312. The biasing rod 932 is disposed so as to be opposed to the moving rod 9311. As shown in the drawing, a biasing rod 932 is fitted into a hole provided to the support member 934 so as to move forward and backward through the hole in the stroke direction SD93. It should be noted that the support member 934 is fixed with respect to the substrate holding section 91. Further, the support member 935 fixed to the substrate holding section 91 and the biasing rod 932 are connected to each other via a biasing member 936, thus the biasing rod 932 is biased in the stroke direction SD93.

Further, the moving operation of the lens array 299 with the array moving mechanism 93 can be performed as follows. Firstly, subsequently to the mounting of the head substrate 293 on the substrate holding section 91, the spacer 297 is mounted on the head substrate 293. In this state, the lens array 299 is located between the moving rod 9311 and the biasing rod 932 of the array moving mechanism 93. Further, by rotating the knob 9312 to adjust an amount of the movement of the moving rod 9311, the lens array 299 is held between the moving rod 9311 and the biasing rod 932. By moving the moving rod forward and backward in the state of holding the lens array 299 between the both rods 9311, 932, the lens array 299 can be moved in the stroke direction SD93. It should be noted that on this occasion the biasing rod 932 is biased towards the moving rod 9311 in the stroke direction SD93. Therefore, the lens array 299 is moved while being held between the moving rod 9311 and the biasing rod 932 with biasing force thus applied.

The second array moving mechanism 95 is provided with a micrometer head 951 and a biasing rod 952. Further, the lens array 299 can be moved in a stroke direction SD95 by rotating a knob 9512 to move a moving rod 9511 as a spindle of the micrometer head 951 forward and backward. It should be noted that since the configuration and the operation of the second array moving mechanism 95 are substantially the same as those of the first array moving mechanism 93, detailed explanations therefor will be omitted.

Further, the third array moving mechanism 97 is provided with a micrometer head 971 and a biasing rod 972. The micrometer head 971 and the biasing rod 972 of the array moving mechanism 97 are different from those of the array moving mechanisms 93, 95 in that the lens array 299 is held therebetween in the longitudinal direction LGD. Further, the lens array 299 can be moved in a stroke direction SD97 by rotating a knob 9712 to move a moving rod 9711 as a spindle of the micrometer head 971 forward and backward. It should be noted that since the configuration and the operation of the third array moving mechanism 97 are substantially the same as those of the first array moving mechanism 93, detailed explanations therefor will be omitted.

As shown in FIG. 13, the stroke directions SD93, SD95 are substantially parallel to the width direction LTD, and the stroke direction SD97 is substantially parallel to the longitudinal direction LGD. Therefore, the first and second array moving mechanisms 93, 95 have a function of moving the lens array 299 in the width direction LTD, and the third array moving mechanism 97 has a function of moving the lens array 299 in the longitudinal direction LGD.

The observation optical system 99 is disposed so as to view one end area in the longitudinal direction LGD of the head substrate 293 or the lens array 299 from an upper side in the direction of gravitational force. In other words, the observation optical system 99 reflects various parts (e.g., the lens array 299) of the line head 29 from the direction of the optical axis OA of the lens LS, and the image taken by a camera 991 corresponds to an image projected on a plane perpendicular to the optical axis OA of the lens LS. Further, the image reflected by the observation optical system 99 is acquired in an image processing section 981, and the image processing section 981 can execute various kinds of signal processing on the image thus acquired. Further, the position adjustment operation can be executed using the position adjustment device 9 described above in a manner as described below.

Figure 16:
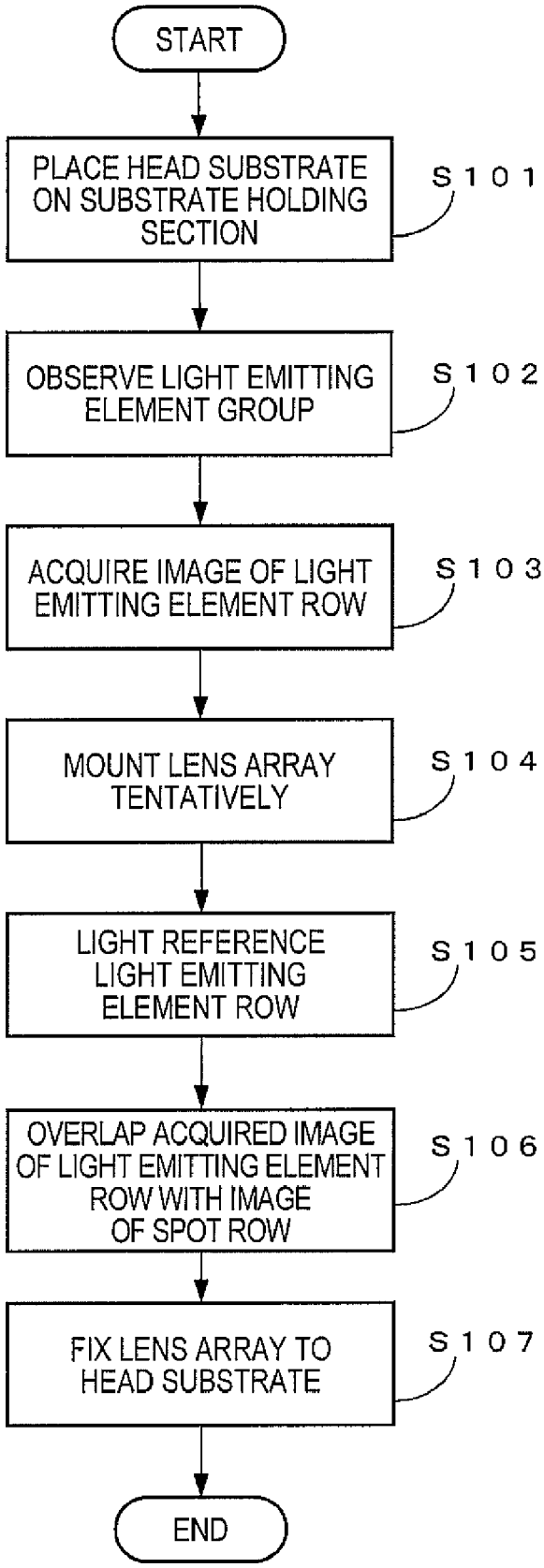
FIG. 16 is a flowchart showing a position adjustment operation.
Figure 17:
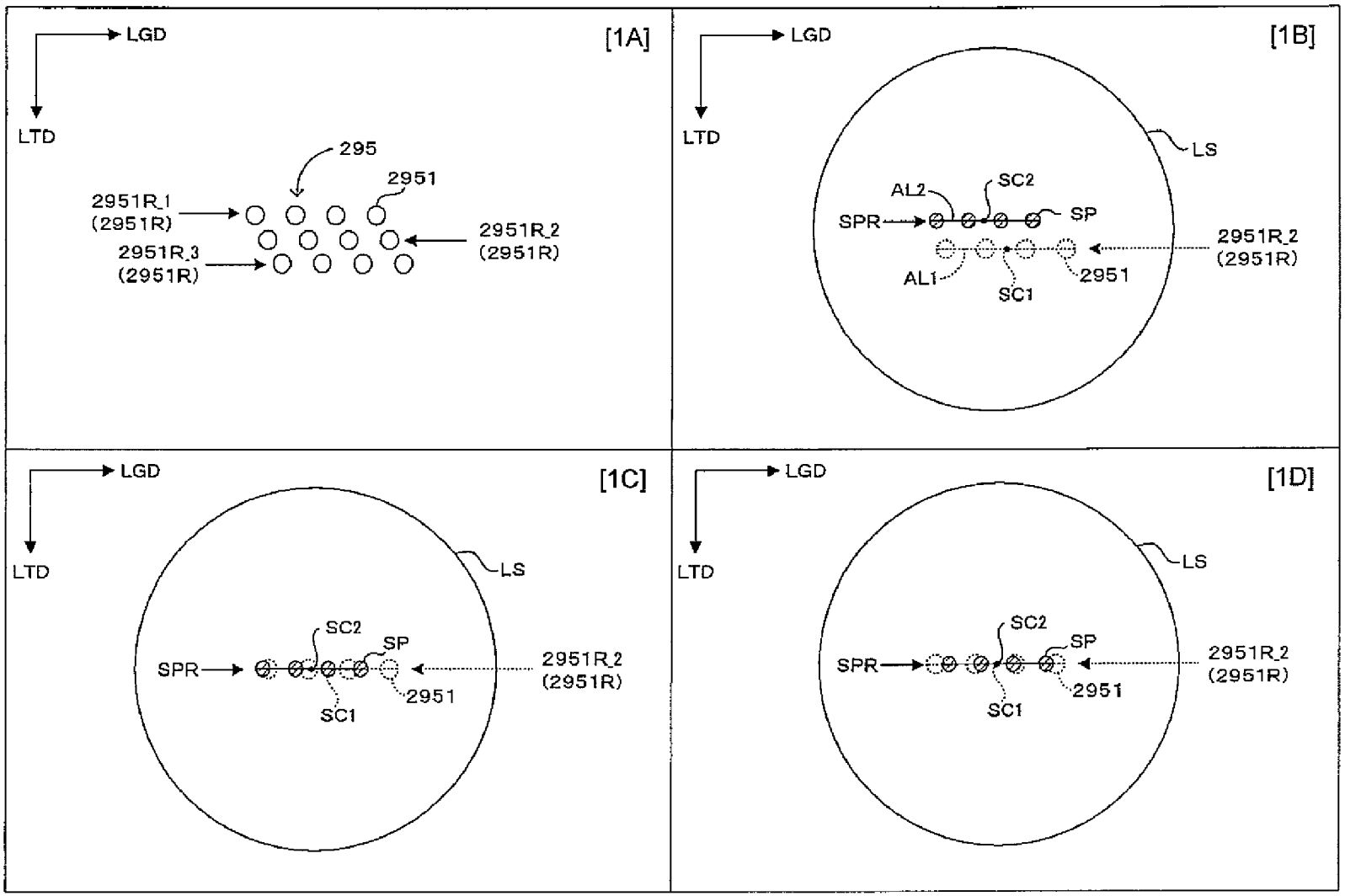
FIG. 17 is a diagram showing images reflected by the observation optical system in the position adjustment operation according to the first embodiment.

FIG. 16 is a flowchart showing the position adjustment operation of the line head. FIG. 17 is a diagram showing images reflected by the observation optical system in the position adjustment operation according to the first embodiment. In the step S101, the head substrate 293 is disposed on the substrate holding section 91 (the substrate disposing step). In the step S102 subsequent thereto, the observation optical system 99 observes the light emitting element group 295 of the head substrate 293 (the column "1A" of FIG. 17), and then the image of the light emitting element group 295 is transmitted to the image processing section 981. In the image processing section 981, the image of the light emitting element row 2951R_2 is obtained based on the image thus transmitted (the step S103, the image obtaining step). In other words, the image processing section 981 obtains the image of the light emitting element row 2951R_2 matching with the meridian plane PL_lgd in the condition in which the alignment has been executed. It should be noted that the light emitting element row matching with the meridian plane PL_lgd in the condition in which the alignment has been executed will hereinafter be specifically referred to as "a reference light emitting element row."

In the step S104 subsequent thereto, the lens array 299 is tentatively mounted. It should be noted that "tentatively mounting" denotes that the lens array 299 is disposed so as to be opposed to the head substrate 293 in the condition in which the lens array 299 is movable to the head substrate 293. Specifically, in the step S104, the spacer 297 is mounted on the head substrate 293, and the lens array 299 is subsequently mounted on the spacer 297 (the tentatively mounting step). On this occasion, the lens array 299 is mounted so that the lenses LS correspond respectively to the light emitting element groups 295.

In the step S105, in the condition in which the lens array 299 is thus tentatively mounted, each of the light emitting elements 2951 of the reference light emitting element row 2951R_2 emits light, and the light beam from each of the light emitting elements 2951 is imaged as the spot SP by the lens LS. Thus, the spot row SPR composed of a plurality of spots SP is formed (the column "1B" of FIG. 17). On this occasion, in correspondence with the fact that the light emitting elements 2951 of the reference light emitting element row 2951R_2 are disposed symmetrically with respect to the symmetry center SC1, the spots SP of the spot row SPR are disposed symmetrically with respect to the symmetry center SC2. It should be noted that, as explained above with reference to FIG. 11, in the condition in which the alignment has been executed, the light emitting elements 2951 of the reference light emitting element row 2951R_2 are disposed symmetrically around the optical axis OA. Therefore, in the condition in which the alignment has been executed, the symmetry center SC1 matches with the optical axis OA, and at the same time, the symmetry center SC2 corresponding to the image of the symmetry center SC1 by the lens LS also matches with the optical axis OA.

As shown in the column "1B" of FIG. 17, the alignment between the light emitting element groups 295 and the lenses LS has not been executed at the instant of the step S105, the reference light emitting element row 2951R_2 and the spot row SPR are shifted from each other. It should be noted that the image of the reference light emitting element row 2951R_2 obtained by the image processing section 981 in the step S103 is reflected in the image of the observation optical system 99 with dashed circles (FIG. 17). Further, there are drawn an additional line AL1 passing through the centers of the light emitting elements 2951 of the reference light emitting element low 2951R_2, and an additional line AL2 passing through the centers of the spots of the spot row SPR (FIG. 17). These additional lines AL1, AL2 are lines drawn by the image processing section 981 in order for making the alignment operation in the subsequent step S106 easy.

In the step S106, the array moving mechanisms 93, 95, and 97 move the lens array 299 to execute the alignment between the light emitting groups 295 and the lenses LS. Specifically, the image of the reference light emitting element row 2951R_2 and the spot row SPR are firstly overlapped with each other in the width direction LTD to execute the alignment in the width direction LTD of the lens array 299 (the column "1C" of FIG. 17). On this occasion, the alignment in the width direction LTD can easily be executed by overlapping the additional lines AL1, AL2 with each other. As described above, according to the first embodiment, it is possible to execute the alignment in the width direction LTD with ease and high accuracy by performing the alignment using the reference light emitting element row 2951R_2 as a reference. Further, the alignment in the longitudinal direction LGD is executed as follows. Specifically, by overlapping the symmetry center SC1 of the reference light emitting element row 2951R_2 and the symmetry center SC2 of the spot row SPR with each other, the alignment in the longitudinal direction LGD is executed (the column "1D" of FIG. 17). When the alignment in both of the width direction LTD and the longitudinal direction LGD is completed in a manner as described above, the lens array 299 is fixed to the head substrate 293 (the step S107).

C. Second Embodiment

In the first embodiment, an odd number (three light emitting element rows 2951R_1, 2951R_2, and 2951R_3) of light emitting element rows 2951R, each having an even number (four) of light emitting elements 2951 aligned along the longitudinal direction, are arranged in parallel in the width direction LTD in each of the light emitting element groups 295. However, the number of light emitting element rows 2951R and the number of light emitting elements 2951 forming each of the light emitting element rows 2951R are not limited thereto, but it is also possible to constitute the light emitting element groups 295 as follows, for example.

Figure 18:
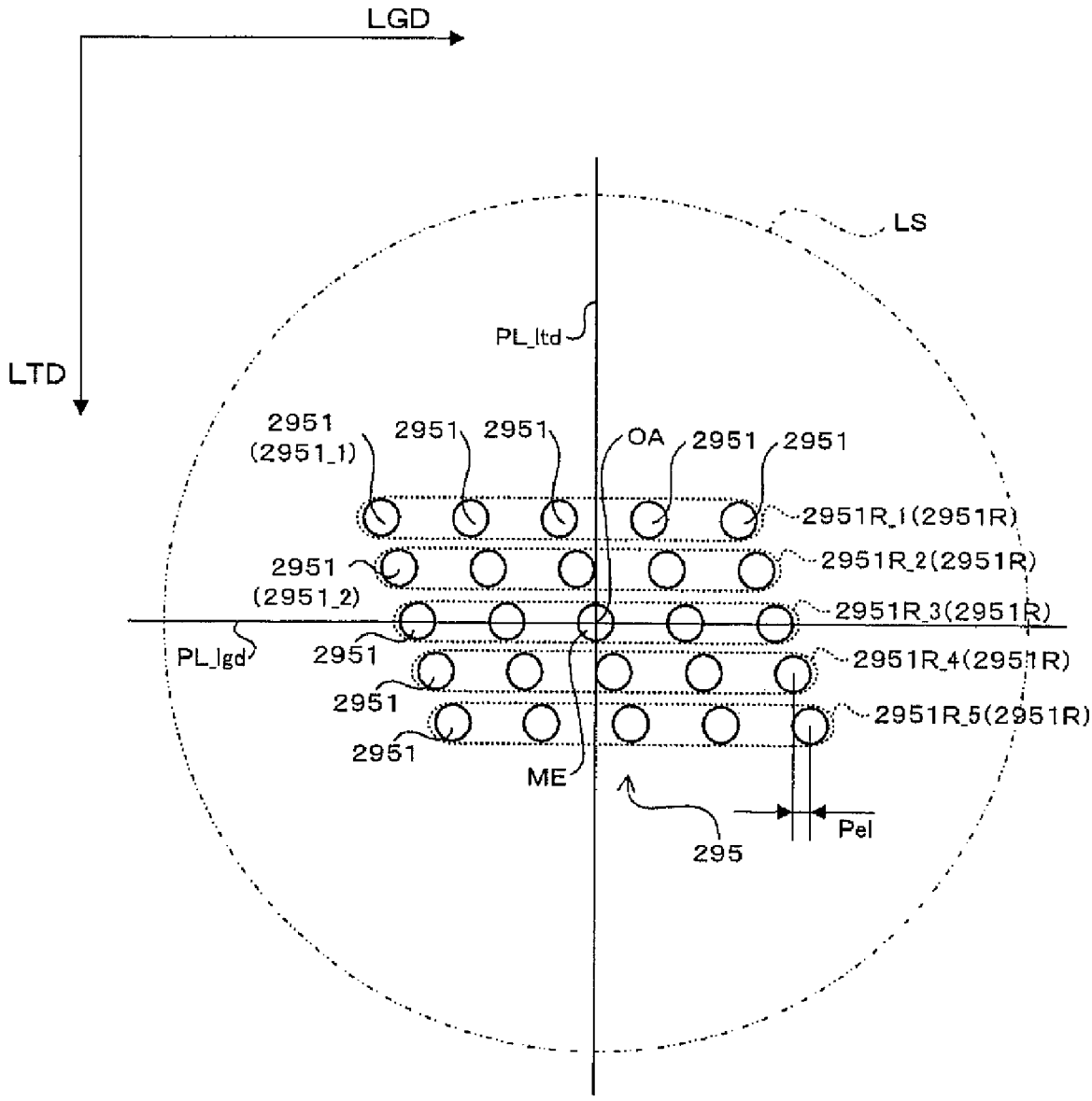
FIG. 18 is a diagram showing a configuration of a light emitting element group in the second embodiment.

FIG. 18 is a diagram showing a configuration of the light emitting element group in the second embodiment. As shown in the drawing, an odd number (five light emitting element rows 2951R_1 through 2951R_5 in the drawing) of light emitting element rows 2951R, each having an odd number (five) of light emitting elements 2951 aligned along the longitudinal direction, are arranged in parallel in the width direction LTD. The light emitting element rows 2951R_1 through 2951R_5 are arranged so as to be shifted the light emitting element pitch Pel from each other in the longitudinal direction LGD, and the light emitting elements 2951 are located at positions different from each other in the longitudinal direction LGD. Therefore, the spot latent images adjacent to each other in the main-scanning direction MD are respectively formed by the light emitting elements 2951 (e.g., the light emitting elements 2951_1, 2951_2 in the drawing) belonging to the different light emitting element rows 2951R from each other.

As described above, also in the second embodiment, the light emitting element rows 2951R are shifted from each other in the longitudinal direction LGD so that the two light emitting elements 2951 for forming the spot latent images adjacent to each other in the main-scanning direction MD belong to the light emitting element rows 2951R different from each other. Specifically, the two light emitting elements 2951_1, 2951_2 forming the spot latent image adjacent to each other in the main-scanning direction MD belong respectively to the light emitting element rows 2951R_1, 2951R_2 different from each other, for example. In this manner, the two light emitting elements 2951 (e.g., 2951_1, 2951_2) forming the spot latent images adjacent to each other in the main-scanning direction MD are disposed so as to be shifted from each other in the width direction LTD, thus the light emitting elements 2951 can be formed in a relatively large space. As a result, it becomes possible to increase the size of the light emitting element 2951, and therefore, it becomes possible to preferably form the spot latent images with a sufficient amount of light even in high-resolution conditions.

Further, in the second embodiment, in the light emitting element group 295, one light emitting element row 2951R_3 of the five light emitting element rows 2951R matches with the meridian plane PL_lgd. In other words, each of the light emitting elements 2951 of the light emitting element row 2951R_3 intersects the meridian plane PL_lgd. In the light emitting element row 2951R_3, the light emitting elements 2951 are disposed symmetrically around the optical axis OA, and a middle light emitting element ME at the center of the light emitting element row 2951R_3 is located on the optical axis OA as the symmetry center.

Further, in the light emitting element group 295, the light emitting element row 2951R_3 matching with the meridian plane PL_lgd is centered, and the other light emitting element rows 2951R are disposed on both sides thereof in the width direction LTD. In other words, in the width direction LTD, the same number (two in the second embodiment) of light emitting element rows 2951R are disposed respectively on both sides of the light emitting element row 2951R_3. Therefore, also in the second embodiment, it becomes possible to image the light beam emitted from each of the light emitting elements 2951 by the lens LS with a preferable aberration.

As described above, in the second embodiment, the light emitting element row 2951R_3 matches with the meridian plane PL_lgd. Therefore, it becomes possible to execute the alignment in the width direction LTD with ease and high accuracy by performing the alignment using the light emitting element row 2951R_3 (i.e., the reference light emitting element row 2951R_3) as a reference. In the second embodiment, the light emitting element ME of the light emitting element row 2951R_3 is disposed on the optical axis OA, and the alignment in the longitudinal direction LGD can more easily and more accurately be executed. Further, by forming the latent images with the line head 29 in which the alignment has thus been performed with high accuracy, the preferable spot latent image formation becomes possible. Then, the position adjustment operation for executing the alignment will hereinafter explained.

Figure 19:
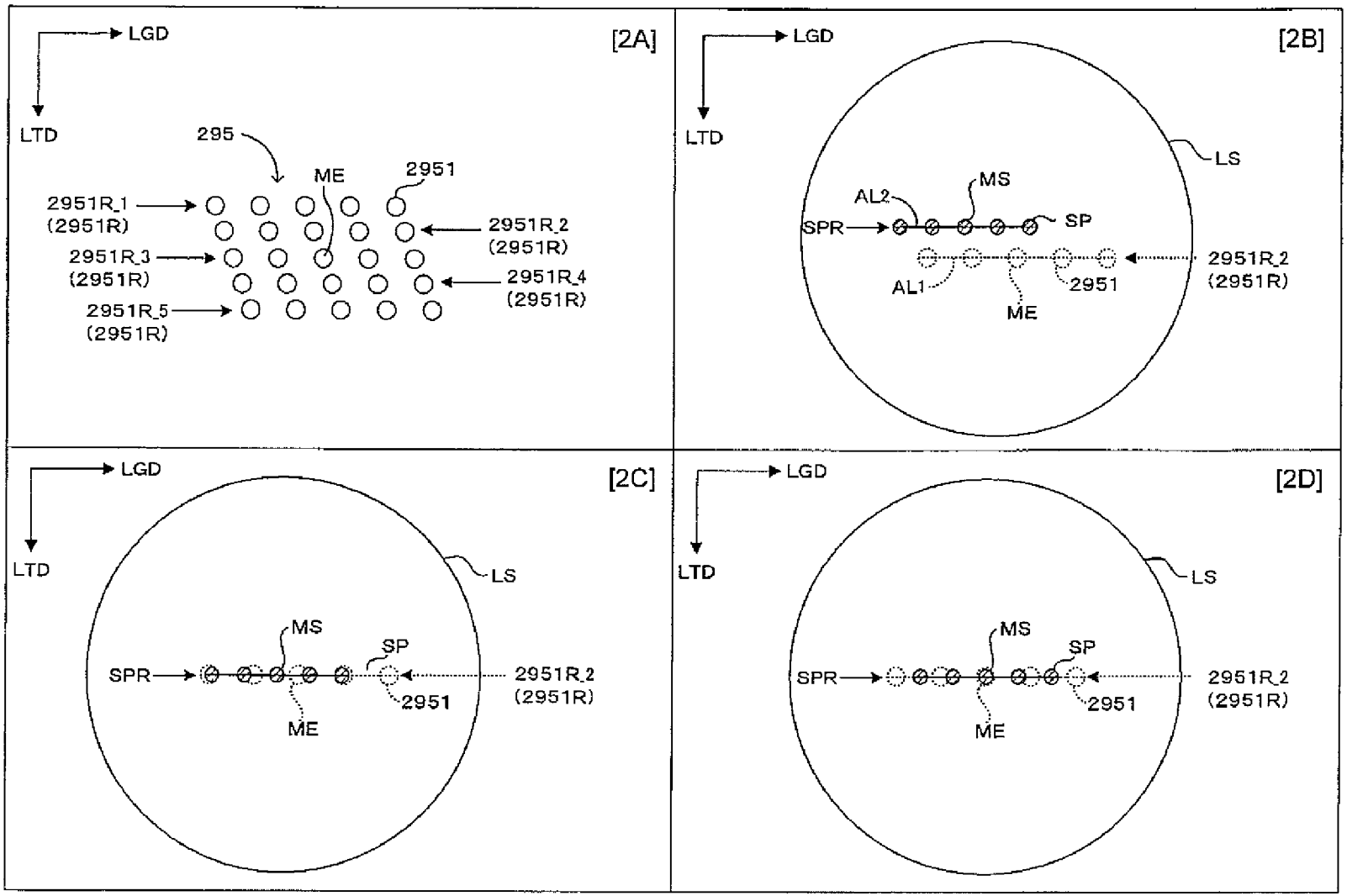
FIG. 19 is a diagram showing images reflected by the observation optical system in the position adjustment operation according to the second embodiment.

FIG. 19 is a diagram showing images reflected by the observation optical system in the position adjustment operation according to the second embodiment. It should be noted that the flow of the position adjustment operation in the second embodiment is substantially the same as described in the flowchart shown in FIG. 16 presented in the first embodiment. Therefore, hereinafter, the position adjustment operation according to the second embodiment will be explained with reference to FIGS. 16 and 19. Further, in the following description, the difference from the position adjustment operation in the first embodiment will mainly be explained, and the explanation of the portions common to each other will be omitted.

In the step S102, the image (the column "2A" of FIG. 19) of the light emitting element group 295 observed by the observation optical system 99 is transmitted to the image processing section 981. In the image processing section 981, the image of the reference light emitting element row 2951R_3 is obtained based on the image thus transmitted (the step S103, the image obtaining step). Then, when the lens array 299 is tentatively mounted (the step S104), the light emitting elements 2951 of the reference light emitting element row 2951R_3 emit light subsequently to the step S104 (the step S105). The light beams from the light emitting elements 2951 are imaged as the spots SP by the lens LS, and the spot row SPR is formed (the column "2B" of FIG. 19). On this occasion, in correspondence with the fact that the light emitting elements 2951 of the reference light emitting element row 2951R_3 are disposed symmetrically with respect to the symmetry center, the spots SP of the spot row SPR are disposed symmetrically with respect to the symmetry center. Particularly in the second embodiment, since the middle light emitting element ME at the center of the light emitting element row 2951R_3 is located at the symmetry center, the middle spot MS, which is the image of the middle light emitting element ME, is located at the symmetry center of the spot row SPR. It should be noted that as is explained with reference to FIG. 18, in the condition in which the alignment in both of the width direction LTD and the longitudinal direction LGD has been executed, the middle light emitting element ME of the reference light emitting element row 2951R_3 is located at the optical axis OA. Therefore, in the condition in which the alignment has thus been executed, the middle light emitting element ME and the middle spot MS as the image of the middle light emitting element ME by the lens LS both match with the optical axis OA.

As shown in the column "2B" of FIG. 19, the alignment between the light emitting element groups 295 and the lenses LS has not been executed at the instant of the step S105, the reference light emitting element row 2951R_3 and the spot row SPR are shifted from each other. In the step S106 subsequent to the step S105, the array moving mechanisms 93, 95, and 97 move the lens array 299 to execute the alignment between the light emitting groups 295 and the lenses LS. Specifically, the image of the reference light emitting element row 2951R_3 and the spot row SPR are firstly overlapped with each other in the width direction LTD to execute the alignment in the width direction LTD of the lens array 299 (the column "2C" of FIG. 19). On this occasion, the alignment in the width direction LTD can easily be executed by overlapping the additional lines AL1, AL2 with each other. As described above, according also to the second embodiment, it is possible to execute the alignment in the width direction LTD with ease and high accuracy by performing the alignment using the reference light emitting element row 2951R_3 as a reference. Further, the alignment in the longitudinal direction LGD is executed as follows. specifically, by overlapping the middle light emitting element ME of the reference light emitting element row 2951R_3 and the middle spot MS of the spot row SPR with each other, the alignment in the longitudinal direction LGD is executed (the column "2D" of FIG. 19). When the alignment in both of the width direction LTD and the longitudinal direction LGD is completed in a manner as described above, the lens array 299 is fixed to the head substrate 293 (the step S107).

As described above, in the present embodiment, the main-scanning direction MD and the longitudinal direction LGD correspond to "a first direction" of the invention, and the sub-scanning direction SD and the width direction LTD correspond to "a second direction" of the invention. Further, the photoconductor drum 21 corresponds to "a latent image carrier" of the invention, the surface of the photoconductor drum 21 corresponds to "an exposed surface" or "an image plane" of the invention, and the head substrate 293 corresponds to "a substrate" of the invention. Further, the line head 29 corresponds to "an exposure head" of the invention, and the spot SP corresponds to "a light-collected section" of the invention.

Other Issues

It should be noted that the invention is not limited to the embodiment described above, but can variously be modified besides the embodiment described above within the scope of the invention. For example, the number of light emitting element rows 2951R and the number of light emitting elements 2951 forming each of the light emitting rows 2951R are not limited to the content shown in the embodiments described above, but can be modified according to needs.

Further, although in the embodiments described above the three light emitting element group rows 295R are arranged in the width direction LTD, the number of light emitting element group rows 295R is not limited to three, but can be modified according to needs.

Further, although in the embodiments described above the light emitting elements 2951 in the reference light emitting element row is disposed symmetrically with respect to the optical axis OA, it is not essential to the invention to arrange the light emitting elements 2951 in such a manner. In essence, by constituting the line head 29 so that the reference light emitting element row matches with the meridian plane PL_lgd, the advantage of the invention that the alignment in the width direction LTD is executed with ease and high accuracy can be obtained.

Further, in the second embodiment, there is provided the middle light emitting element ME matching with the optical axis OA. However, it is not essential to the invention to provide such a middle light emitting element ME. In essence, by constituting the line head 29 so that the reference light emitting element row matches with the meridian plane PL_lgd, the advantage of the invention that the alignment in the width direction LTD is executed with ease and high accuracy can be obtained.

Further, in the embodiments described above, the additional lines AL1, AL2 are provided, and the alignment is executed by overlapping these additional lines AL1, AL2 with each other. However, it is not essential to the invention to provide these additional lines AL1, AL2, and it is also possible to execute the alignment by overlapping the reference light emitting element row and the spot row instead of using such additional lines AL1, AL2.

Further, although in the embodiments described above anamorphic lenses are adopted as the lenses LS, it is also possible to adopt non-anamorphic lenses as the lenses LS.

Further, in the embodiments described above, the line head 29 having the reference light emitting element row matching with the meridian plane PL_lgd is explained. However, the advantage of the invention can be obtained not only with the line head 29 having the reference light emitting element row matching with the meridian plane PL_lgd but also with the line head 29 having the reference light emitting element row substantially matching with the meridian plane PL_lgd. The reason is that such alignment can be executed with ease and high accuracy by performing the alignment between the light emitting elements 2951 and the lens LS so that the reference light emitting element row 2951R_2 substantially matches with the meridian plane PL_lgd. It should be noted that the phrase "the reference light emitting element row 2951R substantially matches with the meridian plane PL_lgd" corresponds to the case in which one or more of the light emitting elements 2951 of the reference light emitting element row 2951R intersect the meridian plane PL_lgd. Here, the extent in which the reference light emitting element row matches or substantially matches with the meridian plane PL_lgd will specifically be explained with reference to the accompanying drawings.

Figure 20:
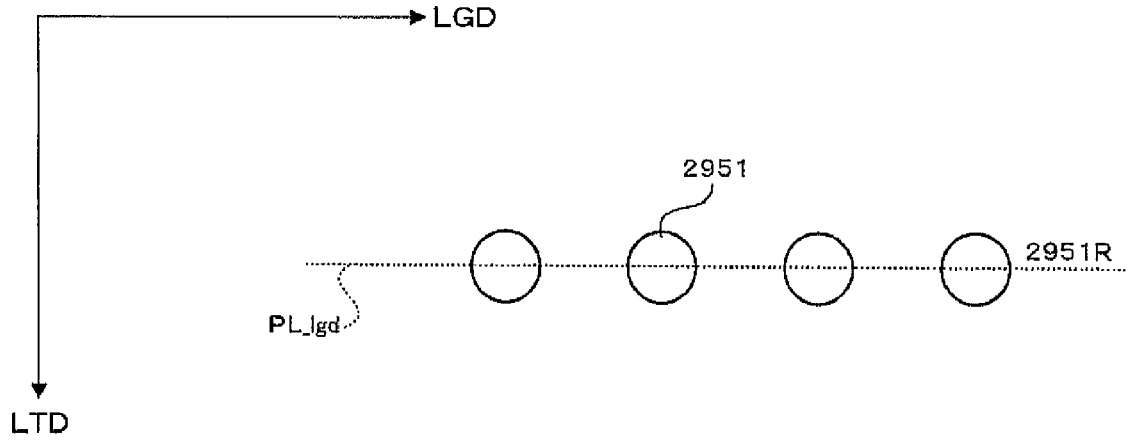
FIG. 20 is a diagram for explaining the case in which the light emitting element row matches with a meridian plane.
Figure 21:
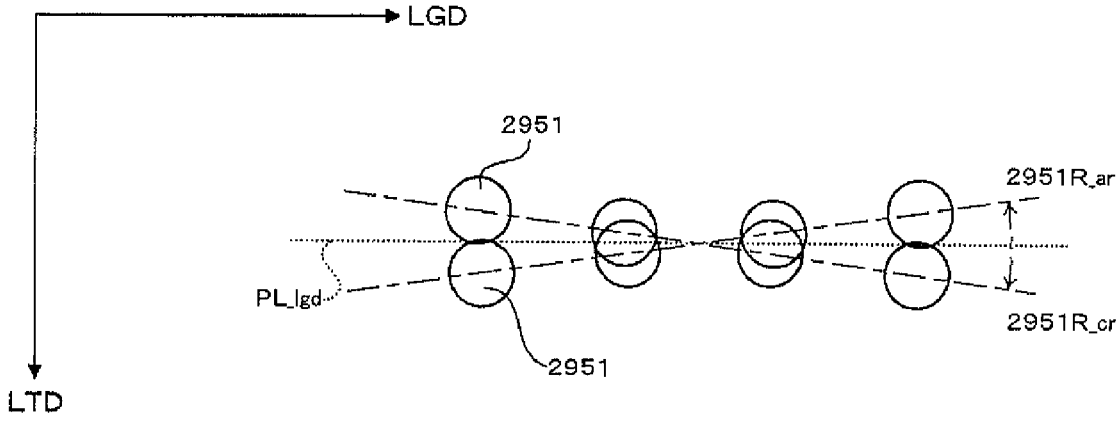
FIG. 21 is a diagram for explaining the case in which the light emitting element row matches approximately with the meridian plane.

FIG. 20 is a diagram for explaining the case in which the light emitting element row matches with the meridian plane PL_lgd. FIG. 21 is a diagram for explaining the case in which the light emitting element row substantially matches with the meridian plane PL_lgd. As described above, the meridian plane PL_lgd of the lens LS is parallel to the longitudinal direction LGD. Further, in FIG. 20, the meridian plane PL_lgd passes through the center of each of the light emitting elements 2951 of the light emitting element row 2951R. This case corresponds to the phrase "the meridian plane PL_lgd matches with the light emitting element row 2951R." On the other hand, in FIG. 21, there are displayed in an overlapping manner two examples each showing the case in which the light emitting element row 2951R substantially matches with the meridian plane PL_lgd. Here, the light emitting element row 2951R_cr is explained as a representative case. As shown in the drawing, one or more of the light emitting elements 2951 of the light emitting element row 2951R_cr intersect the meridian plane PL_lgd. As described above, in this specification, the phrase "the light emitting element row 2951R matches of substantially matches with the meridian plane PL_lgd" denotes the state in which one or more of the light emitting elements 2951 of the light emitting element row 2951R intersect the meridian plane PL_lgd.

Figure 22:
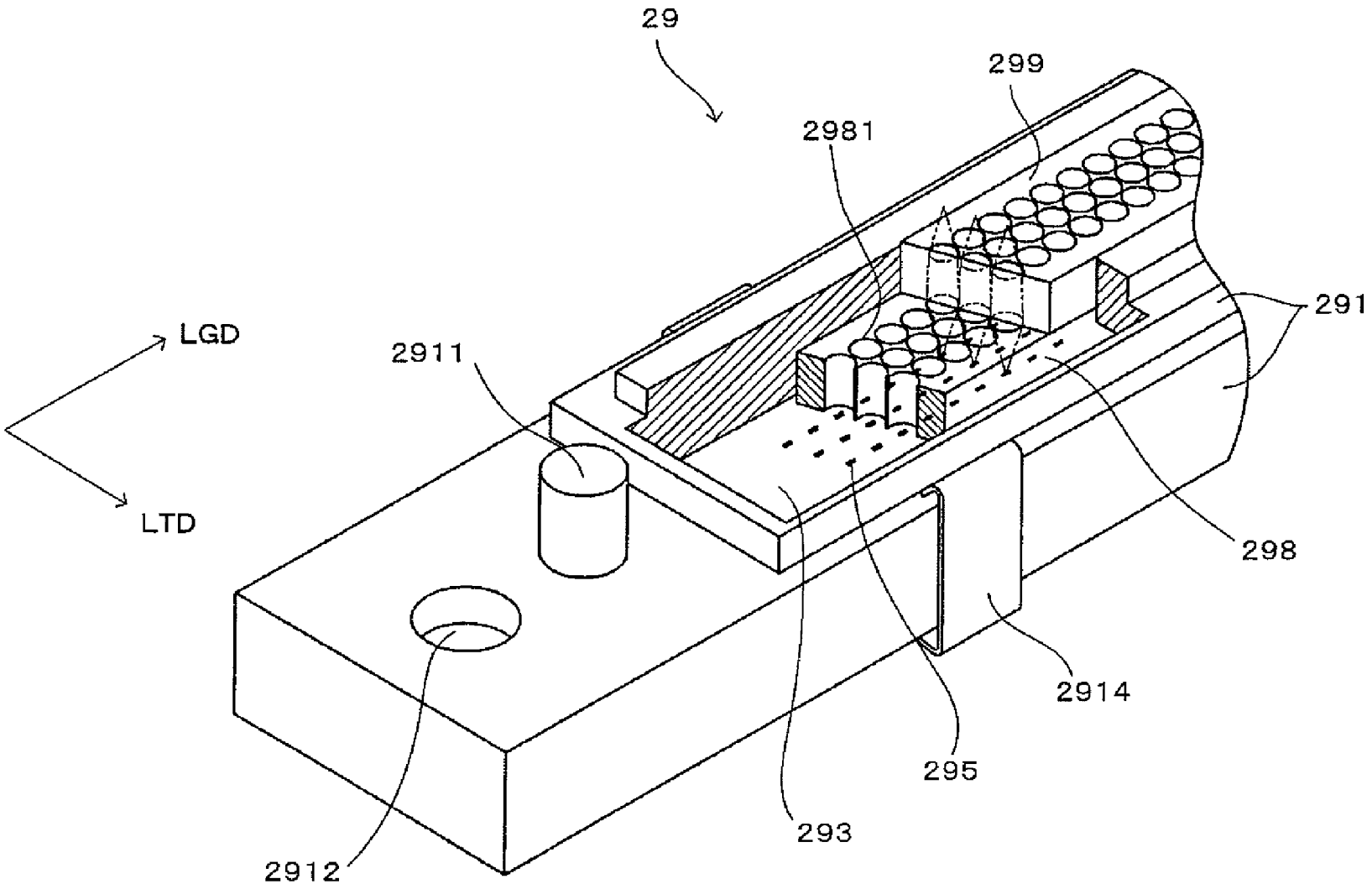
FIG. 22 is a perspective view showing a schematic configuration of a line head provided with a light shielding member.
Figure 23:
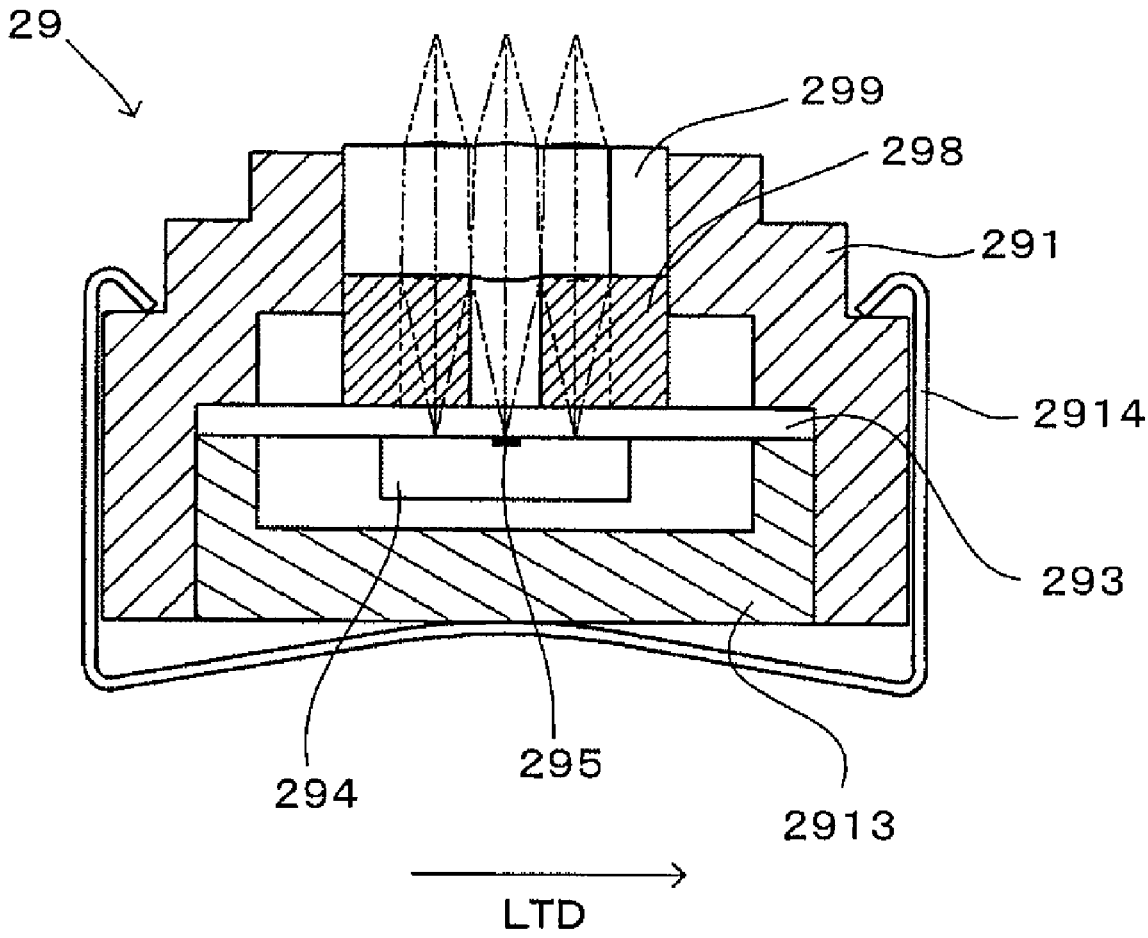
FIG. 23 is a cross-sectional view along the width direction showing a schematic configuration of the line head provided with the light shielding member.

Further, although in the embodiments described above, there is disposed the spacer 297 between the head substrate 293 and the lens array 299, it is possible to dispose a light-shielding member instead of the spacer 297. FIG. 22 is a perspective view showing a schematic configuration of a line head provided with the light shielding member. FIG. 23 is a perspective view showing a schematic configuration of the line head provided with the light shielding member. Hereinafter, different sections between an embodiment shown in FIGS. 22, 23 and the embodiments described above will mainly be explained, while the common sections are denoted with the same reference numerals, and the explanations therefor will be omitted. As shown in these drawings, the light-shielding member 298 is disposed between the head substrate 293 and the lens array 299. The light shielding member 298 is provided with a plurality of light guide holes 2981 penetrating the light shielding member corresponding one-on-one to the plurality of light emitting element groups 295. The light guide holes 2981 penetrate the light-shielding member 298 from the light emitting element groups 295 to the lenses LS opposed to the light emitting element groups 295, respectively. Therefore, the light beams from the light emitting element groups 295 pass through the light guide holes 2981, and then imaged as the spots SP by the lenses LS, respectively. In contrast, the stray light, which is a part of each of the light beams from the light emitting element groups 295 and fails to enter the light guide hole 2981, is shielded by the bottom surface of the light-shielding member 2981, and therefore, does not reach the lens LS. As described above, the light-shielding member 298 has a function of preventing the stray light from entering the lenses LS. Therefore, the line head 29 provided with the light-shielding member 298 is capable of performing more preferable latent image formation.

Figure 24:
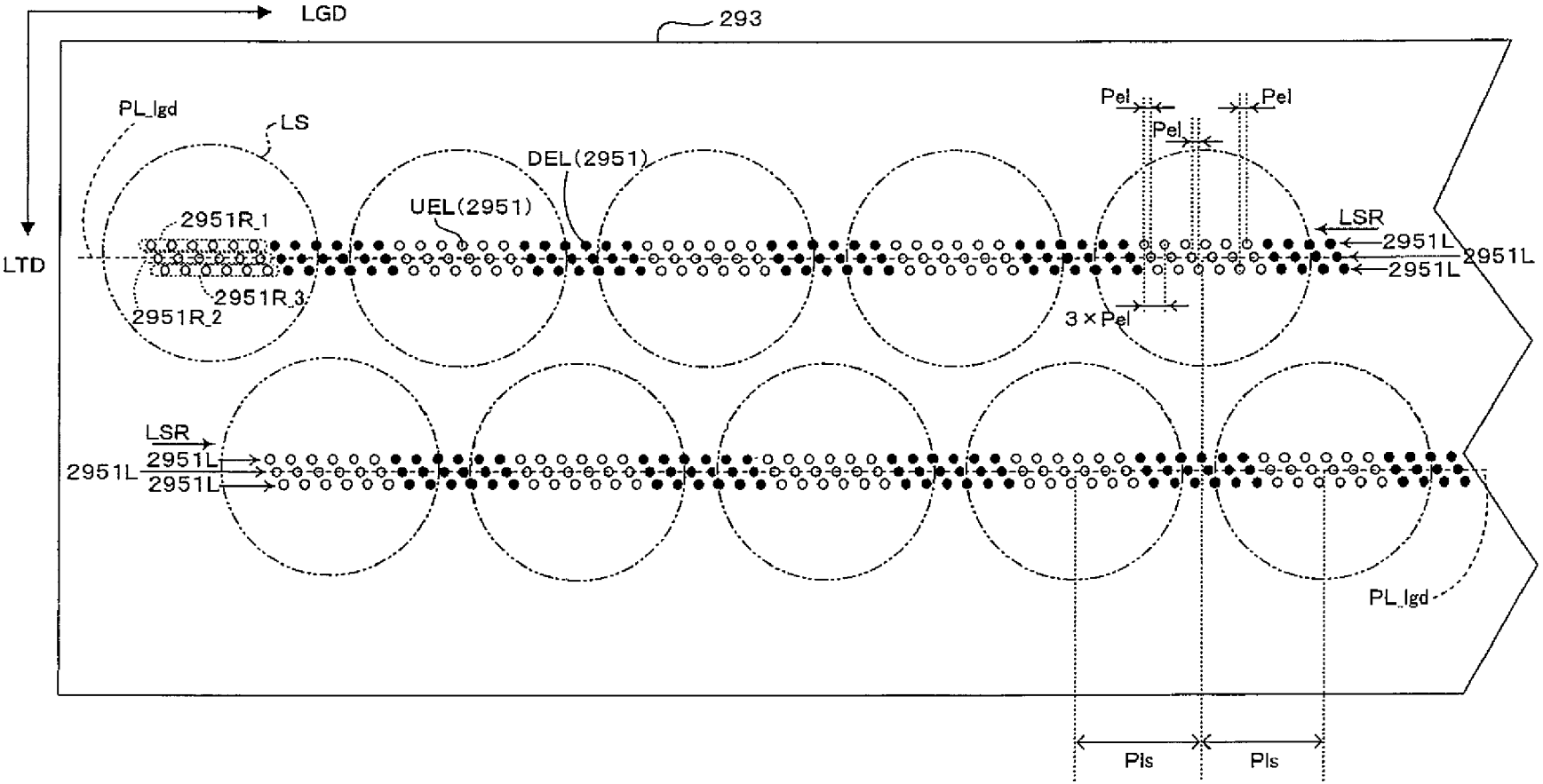
FIG. 24 is a plan view showing another arrangement form of light emitting elements.

Further, in the embodiment described above, the light emitting element groups 295, clusters of a plurality of light emitting elements 2951, are disposed discretely. However, the arrangement form of the light emitting elements 2951 is not limited thereto. FIG. 24 is a plan view showing another arrangement form of light emitting elements. The drawing corresponds to the case of viewing perpendicularly the reverse side surface of the head substrate 293 from the obverse side of the head substrate 293. Further, although the lenses LS are illustrated with double-dashed lines, this is for showing the positional relationship between the light emitting elements 2951 and the lens LS, but not for showing that the lenses LS are disposed on the head substrate 293. In the drawing, the lens row LSR is formed by linearly arranging a plurality of lenses LS in the longitudinal direction LGD at a pitch twice as large as the lens pitch Pls. Further, two lens rows LSR are arranged at positions different from each other in the width direction LTD. Further, these two lens rows LSR are shifted the lens pitch Pls from each other in the longitudinal direction LGD. In such a manner, the lenses LS are disposed at positions different from each other in the longitudinal direction LGD.

Three light emitting element lines 2951L are disposed at positions different from each other in the width direction LTD corresponding to each of the lens rows LSR. The light emitting element line 2951L are each formed by linearly arranging a plurality of light emitting elements 2951 in the longitudinal direction LGD at a pitch twice as large as the light emitting element pitch Pel. The three light emitting element lines 2951L provided to the same lens row LSR are shifted the light emitting element pitch Pel from each other in the longitudinal direction LGD. In such a manner, the light emitting elements 2951 provided to the same lens row LSR are disposed at positions different from each other in the longitudinal direction LGD.

In the drawing, the meridian planes PL_lgd of the lenses LS belonging to the same lens row LSR are illustrated with one broken line. It should be noted that similarly to the embodiments described above, the meridian planes PL_lgd are parallel to the longitudinal direction LGD. Further, the light emitting element line 2951L positioned at the center of the three light emitting element lines 2951L matches with the meridian plane PL_lgd.

In the line head 29 having the light emitting elements 2951 disposed as described above, all of the light emitting elements 2951 do not necessarily contribute to the latent image formation, but some of the light emitting elements 2951 contribute to the latent image formation. In other words, the light emitting elements DEL (the light emitting elements 2951 illustrated with filled circles) located relatively distantly from the optical axis of the lens LS do not contribute to the latent image formation, and the light emitting elements UEL (the light emitting elements 2951 illustrated with open circles) located relatively close to the optical axis of the lens LS contribute to the latent image formation. Specifically, 18 used light emitting elements UEL disposed symmetrically with respect to the optical axis of the lens LS contribute to the latent image formation.

Further, these 18 used light emitting elements UEL correspond to the light emitting element group 295 of the embodiments described above. Specifically, each of the light emitting element rows 2951R is composed of 6 used light emitting elements UEL arranged in a line in the longitudinal direction LGD. Further, three light emitting element rows 2951R_1, 2951R_2, and 2951R_3 are disposed at positions different from each other in the width direction LTD, and moreover, the three light emitting element rows 2951R_1, 2951R_2, and 2951R_3 are shifted from each other in the longitudinal direction LGD. Therefore, the two used light emitting elements UEL forming the spots SP adjacent to each other in the main-scanning direction MD are disposed so as to be shifted from each other in the width direction LTD. Therefore, the size of the light emitting element 2951 can be increased, thus the spots SP can be formed with a sufficient amount of light, thereby making it possible to preferably perform the latent image formation.

Further, the light emitting element row 2951R_2 of the three light emitting element rows matches with the meridian plane PL_lgd parallel to the longitudinal direction LGD. Therefore, by executing the alignment between the light emitting elements 2951 and the lenses LS using the light emitting element row 2951R_2 as a reference, the alignment therebetween can be executed with ease and high accuracy. Further, the preferable latent image formation becomes possible using the line head 29 in which the alignment is performed with high accuracy.

Figure 25:
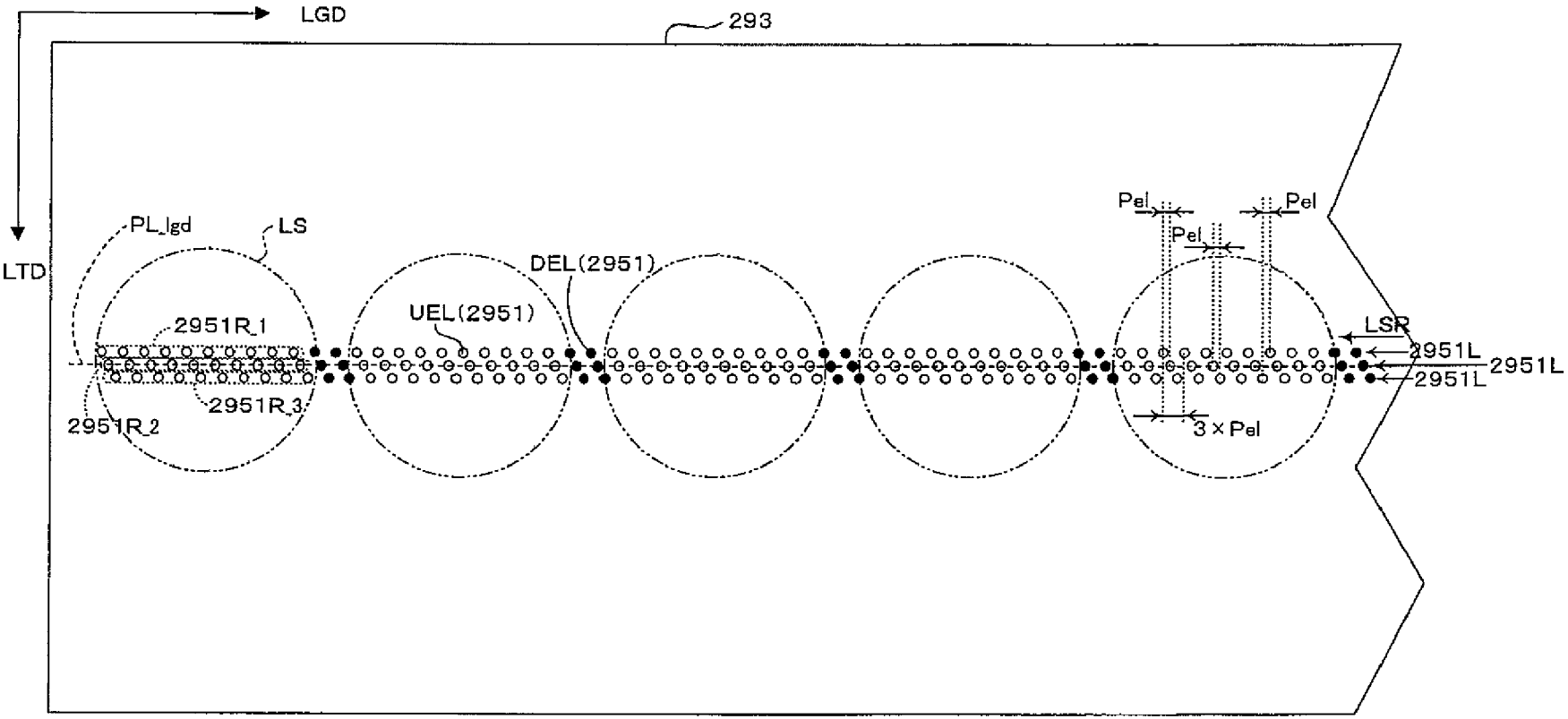
FIG. 25 is a plan view showing a configuration in which the number of lens rows LSR is one.

Incidentally, although in the embodiments described above, the number of lens rows LSR is two or three, the number of lens rows is not limited thereto. FIG. 25 is a plan view showing a configuration in which the number of lens rows LSR is one. The drawing corresponds to the case of viewing perpendicularly the reverse side surface of the head substrate 293 from the obverse side of the head substrate 293. Further, although the lenses LS are illustrated with double-dashed lines, this is for showing the positional relationship between the light emitting elements 2951 and the lens LS, but not for showing that the lenses LS are disposed on the head substrate 293. It should be noted that although the configuration shown in FIG. 25 and the configuration shown in FIG. 24 are different from each other in the number of lens rows LSR, these configurations are basically the same in the other points, and therefore, the configuration shown in FIG. 25 is denoted with the corresponding reference numerals, and the explanations therefor will be omitted.

Figure 26:
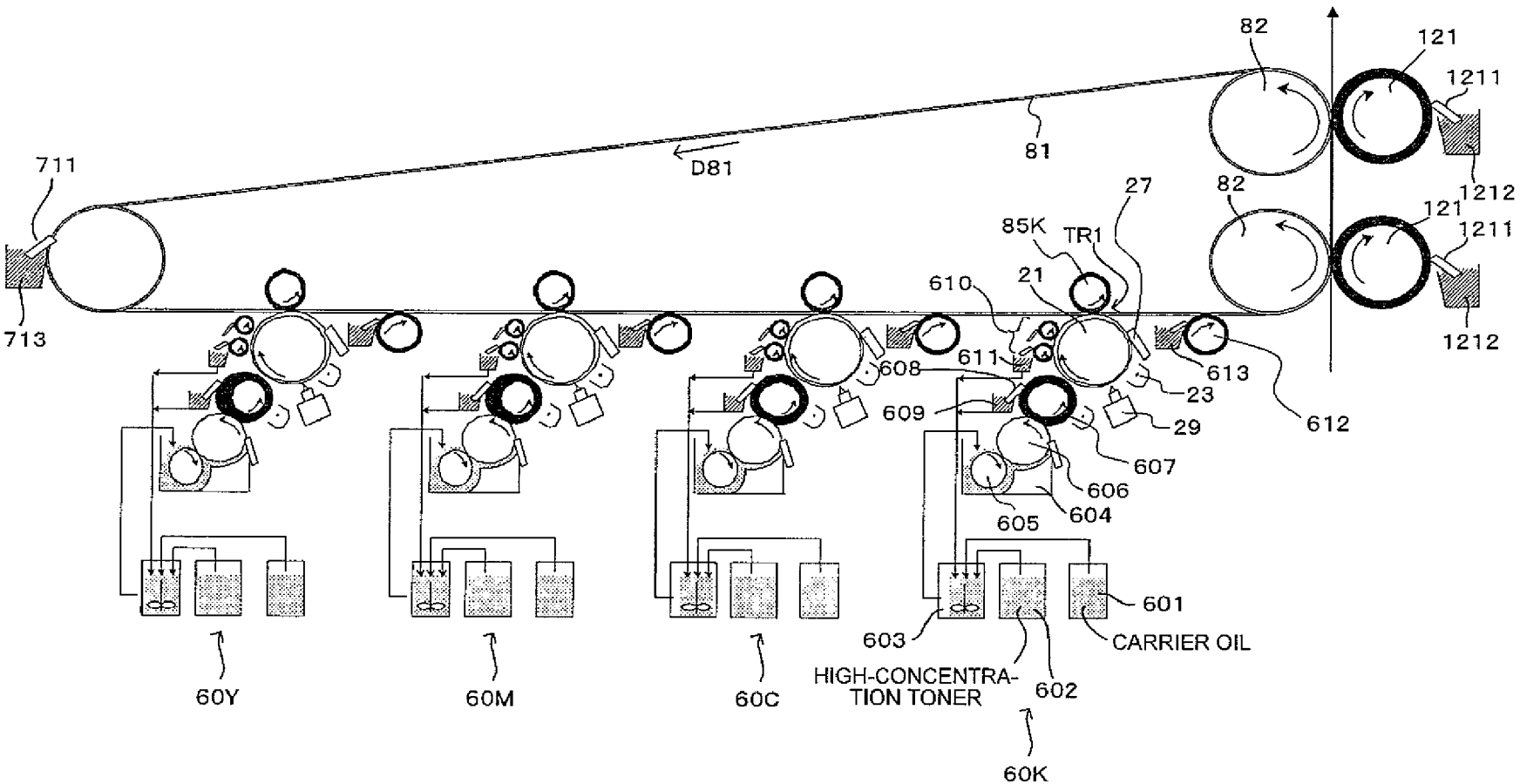
FIG. 26 is a diagram schematically showing a device for performing development with a liquid developer.

Further, although in the embodiments described above, the image formation is executed by developing the latent image using so-called dry toners, it is possible to develop the latent image using liquid developers. FIG. 26 is a diagram schematically showing a device for performing development with a liquid developer. Since the device in the drawing and the device shown in FIG. 3 are mainly different in the configuration of the developing unit, the developing unit will mainly be explained hereinafter, and other sections are denoted with the corresponding reference numerals, and the explanations therefor will be omitted.

There are disposed four developing units 60Y (for yellow), 60M (for magenta), 60C (for cyan), and 60K (for black) corresponding to the respective toner colors side by side along the conveying direction of the intermediate transfer belt 81. Each of the developing units 60Y, 60M, 60C, and 60K is provided with an oil container 601 for containing a carrier oil, a toner container 602 for containing a high-concentration toner, and an agitator 603. The agitator 603 agitates the carrier oil supplied from the oil container 601, the high-concentration toner supplied from the toner container 602 to generate a liquid developer with adjusted concentration. The liquid developer thus generated is supplied to the developer container 604. Inside the developer container 604, there are disposed a supply roller 605 and an anilox roller 606. The lower part of the supply roller 605 is dipped in the liquid developer inside the developer container 604. The supply roller 605 rotates in the direction indicated by the arrow in the drawing to draw up the liquid developer to feed the liquid developer to the anilox roller 606. The anilox roller 606 rotates in the direction indicated by the arrow in the drawing to apply the liquid developer fed from the supply roller 605 to a developing roller 607.

The developing roller 607 has contact with the photoconductor drum 21 at the developing position. The developing roller 607 is rotatable in the direction indicated by the arrow in the drawing, and the liquid developer supplied from the anilox roller 606 is held on the surface of the developing roller 607, and supplied to the developing position. The toner included in the liquid developer supplied as described above adheres to the latent image on the surface of the photoconductor drum, thus the development is executed.

On the downstream side of the developing position in the rotational direction of the developing roller 607, a cleaner blade 608 has contact with the developing roller 607. The cleaner blade 608 strips off the liquid developer from the surface of the developing roller 607, and a recovery container 609 recovers the liquid developer thus tripped off. Further, the liquid developer recovered by the recovery container 609 is returned to the agitator 603, and then reused.

On the downstream side of the developing position in the rotational direction D21 of the photoconductor drum, there are disposed two photoconductor squeezing rollers 610 having contact with the surface of the photoconductor drum 21. Further, the photoconductor squeezing rollers 610 strip off the carrier oil from the surface of the photoconductor drum 21, thus an amount of carrier oil included in the liquid developer on the surface of the photoconductor drum 21 is adjusted Further, the carrier oil thus stripped off is once recovered by the recovery container 611, and then returned to the agitator 603 to be reused.

The image obtained by developing the latent image at the developing position is transferred to the intermediate transfer belt 81 at a primary transfer position TR1. On the downstream side of the primary transfer position TR1 in the conveying direction D81 of the intermediate transfer belt 81, a belt squeezing roller 612 has contact with the intermediate transfer belt 81. Further, the belt squeezing rollers 612 strip off the carrier oil from the surface of the intermediate transfer belt 81, thus an amount of carrier oil included in the liquid developer on the surface of the intermediate transfer belt 81 is adjusted. Further, the carrier oil thus stripped off is recovered by a recovery container 613.

The image thus primary-transferred is secondary-transferred to a paper sheet. The secondary transfer operation is executed by two secondary transfer rollers 82 and the backup rollers 121 disposed so as to be opposed respectively to the two secondary transfer rollers 82. Further, a cleaner blade 1211 is disposed so as to have contact with each of the backup rollers 121 to strip off the liquid developer remaining on each of the backup rollers 121, and the liquid developer thus stripped off is recovered by each of recovery containers 1212.

As described above, in the device shown in FIG. 26, the latent image is developed (liquid-developed) using the liquid developers. Incidentally, in general, according to the liquid development as described above, the development of the latent image can be executed with relatively high resolution. Therefore, it is preferable to perform the development of the spot latent images preferably formed by the embodiments of the invention using the liquid development process.

The entire disclosure of Japanese Patent Application Nos: 2007-299186, filed Nov. 19, 2007 and 2008-243004, filed Sep. 22, 2008 are expressly incorporated by reference herein.

What is claimed is:

1. An exposure head comprising:

a substrate having a plurality of light emitting element rows each comprising a plurality of light emitting elements, the plurality of light emitting elements arranged in a first direction, the plurality of light emitting element rows being arranged in a second direction perpendicular or substantially perpendicular to the first direction; and a plurality of imaging optical systems comprising an array of lenses, each system configured to image light beams from the light emitting elements on an exposed surface to form a light-collected section, each lens of the imaging optical systems corresponding to a group of an odd number of light emitting element rows where the group has at least three light emitting element rows, wherein two of the light emitting elements forming the light-collected sections adjacent to each other in the first direction are disposed in the two different light emitting element rows for the each of the imaging optical systems, and a center row of the at least three light emitting element rows is disposed so as to match or substantially match with the meridian plane of the imaging optical system.

2. The exposure head according to claim 1, wherein, the light emitting elements in the light emitting element row are arranged symmetrically with respect to an optical axis of the imaging optical system.

3. The exposure head according to claim 1, wherein one of the light emitting elements is disposed at an optical axis of the imaging optical system.

4. The exposure head according to claim 1, wherein the imaging optical system is of anamorphic.

5. The exposure head according to claim 1, wherein the imaging optical system inverts the light beam from the light emitting element in imaging the light beam on the exposed surface.

6. The exposure head according to claim 1, wherein the imaging optical system reduces the light beam from the light emitting element in imaging the light beam on the exposed surface.

7. The exposure head according to claim 1, further comprising:

a light-shielding member provided with a light guide hole configured to allow the light beam emitted from the light emitting elements forming two or more of the light emitting element rows to pass to the imaging optical system.

8. The exposure head according to claim 1, wherein the light emitting element is organic EL element.

9. The exposure head according to claim 8, wherein the organic EL element is bottom emission organic EL element.

10. An image forming method comprising:

(a) providing an exposure head according to claim 1;

(b) forming a latent image formed of a light-collected sections on a latent image carrier in the first direction by lighting the light emitting element row at timing corresponding to movement of the latent image carrier;

(c) developing the latent image formed in step (b) to form an image; and (d) transferring the image developed in step (c).

11. An image forming device comprising:

a latent image carrier; and an exposure head having a substrate having a plurality of light emitting element rows each comprising a plurality of light emitting elements, the plurality of light emitting elements arranged in a first direction, the plurality of light emitting element rows being arranged in a second direction perpendicular or substantially perpendicular to the first direction; and a plurality of imaging optical systems comprising an array of lenses, each system configured to image light beams from the light emitting elements of the light emitting element rows on the latent image carrier to form a light-collected section, each lens of the imaging optical systems corresponding to a group of an odd number of light emitting element rows where the grown has at least three light emitting element rows, wherein two of the light emitting elements forming the light collected sections adjacent to each other in the first direction are respectively disposed in the two different light emitting element rows for the each of the imaging optical systems, and a center row of the at least three light emitting element rows is disposed so as to match or substantially match with the meridian plane of the imaging optical system.

12. The image forming device according to claim 11, further comprising:

a developing section is configured to develop a latent image using a liquid developer, the latent image being formed on the latent image carrier by the exposure head.

* * * * *